US011798727B2

(12) United States Patent
Yamauchi et al.

(10) Patent No.: US 11,798,727 B2
(45) Date of Patent: Oct. 24, 2023

(54) INDUCTOR COMPONENT

(71) Applicant: Murata Manufacturing Co., Ltd., Kyoto-fu (JP)

(72) Inventors: Kouji Yamauchi, Nagaokakyo (JP); Yoshimasa Yoshioka, Nagaokakyo (JP); Ryo Kudou, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 466 days.

(21) Appl. No.: 17/036,598

(22) Filed: Sep. 29, 2020

(65) Prior Publication Data

US 2021/0110959 A1 Apr. 15, 2021

(30) Foreign Application Priority Data

Oct. 9, 2019 (JP) ..... 2019-186101

(51) Int. Cl.

| | |
|---|---|
| ***H01F 27/255*** | (2006.01) |
| ***H01F 27/29*** | (2006.01) |
| ***H01F 41/04*** | (2006.01) |
| ***H01F 27/28*** | (2006.01) |
| ***H01F 41/02*** | (2006.01) |

(52) U.S. Cl.

CPC ..... *H01F 27/255* (2013.01); *H01F 27/2804* (2013.01); *H01F 27/29* (2013.01); *H01F 41/0246* (2013.01); *H01F 41/041* (2013.01); *H01F 2027/2809* (2013.01)

(58) Field of Classification Search

CPC .... H01F 27/255; H01F 27/2804; H01F 27/29; H01F 41/0246; H01F 41/041; H01F 2027/2809; H01F 27/324; H01F 41/046; H01F 2017/0073; H01F 2017/048; H01F 17/0013; H01F 17/04

See application file for complete search history.

(56) References Cited

U.S. PATENT DOCUMENTS

| | | | | |
|---|---|---|---|---|
| 2006/0141139 | A1* | 6/2006 | Iorio | C23C 28/3455 427/127 |
| 2013/0222101 | A1* | 8/2013 | Ito | H01F 3/08 336/83 |
| 2014/0176286 | A1* | 6/2014 | Okada | H01F 17/0013 336/200 |
| 2017/0111995 | A1* | 4/2017 | Nishikawa | H01F 27/2804 |

(Continued)

FOREIGN PATENT DOCUMENTS

| | | | |
|---|---|---|---|
| CN | 103180919 | A | 6/2013 |
| JP | 2016-131200 | A | 7/2016 |

(Continued)

*Primary Examiner* — Marlon T Fletcher
*Assistant Examiner* — Matthew T Sarles
(74) *Attorney, Agent, or Firm* — Studebaker & Brackett PC

(57) ABSTRACT

An inductor component includes an inductor wiring line that extends in a plane, a magnetic layer that is formed of an organic resin containing a magnetic powder and that covers the inductor wiring line, and a nonmagnetic-body insulating layer that is formed of an organic resin containing an insulating nonmagnetic powder and that covers a principal surface of the magnetic layer. The inductor component further includes a close-contact layer that is located between the magnetic layer and the insulating layer and that contains the magnetic powder, the nonmagnetic powder, and an organic resin.

19 Claims, 9 Drawing Sheets

(56) References Cited

U.S. PATENT DOCUMENTS

| | | | | |
|---|---|---|---|---|
| 2017/0169930 | A1* | 6/2017 | Kudo | H01F 17/0013 |
| 2018/0286568 | A1* | 10/2018 | Suzuki | H01F 41/122 |
| 2019/0074125 | A1* | 3/2019 | Yoshioka | H01F 27/29 |
| 2019/0244743 | A1* | 8/2019 | Hirai | H01F 27/2804 |
| 2020/0098506 | A1* | 3/2020 | Hamada | H01F 41/0233 |
| 2020/0286674 | A1* | 9/2020 | Han | H01F 41/041 |

FOREIGN PATENT DOCUMENTS

| | | | | | |
|---|---|---|---|---|---|
| JP | 6024243 | B2 | | 11/2016 | |
| JP | 2019-134141 | A | | 8/2019 | |
| JP | 2019134141 | A | * | 8/2019 | H01F 17/0006 |
| KR | 20160064971 | A | * | 6/2016 | |
| WO | WO-2019163292 | A1 | * | 8/2019 | |

* cited by examiner

INDUCTOR COMPONENT

CROSS-REFERENCE TO RELATED APPLICATION

This application claims benefit of priority to Japanese Patent Application No. 2019-186101, filed Oct. 9, 2019, the entire content of which is incorporated herein by reference.

BACKGROUND

Technical Field

The present disclosure relates to an inductor component.

Background Art

As described in, for example, Japanese Patent No. 6024243, some inductor components to be mounted on electronic equipment include an inductor wiring line, a pair of magnetic layers which are formed of an organic resin containing a magnetic powder and between which the inductor wiring line is disposed, and an insulating layer covering the principal surface of the magnetic layer. In Japanese Patent No. 6024243, the insulating layer is formed by treating the principal surface of the magnetic layer with a phosphoric acid salt, thereby forming an inorganic film.

SUMMARY

Inductor components having a configuration in the related art frequently include organic resins such as a solder resist instead of an insulating layer composed of an inorganic film. The present inventors found that the adhesiveness between the insulating layer formed of such an organic resin and the principal surface of the magnetic layer may deteriorate.

Accordingly, the present disclosure provides an inductor component in which the adhesiveness between an insulating layer and the principal surface of a magnetic layer is suppressed from deteriorating.

According to one embodiment of the present disclosure, an inductor component includes an inductor wiring line that extends in a plane, a magnetic layer that is formed of an organic resin containing a magnetic powder and that covers the inductor wiring line, a nonmagnetic-body insulating layer that is formed of an organic resin containing an insulating nonmagnetic powder and that covers a principal surface of the magnetic layer, and a close-contact layer that is located between the magnetic layer and the insulating layer and that contains the magnetic powder, the nonmagnetic powder, and an organic resin.

According to the embodiment, the close-contact layer disposed between the magnetic layer and the insulating layer contains both the magnetic powder contained in the magnetic layer and the nonmagnetic powder contained in the insulating layer. Therefore, the close-contact layer is readily in close contact with the magnetic layer and is readily in close contact with the insulating layer. The close-contact layer that is in close contact with the magnetic layer and the insulating layer and interposed between the magnetic layer and the insulating layer, as described above, enables adhesiveness between the insulating layer and the principal surface of the magnetic layer to be suppressed from deteriorating.

In the present disclosure, the inductor wiring line means the wiring line which provides the inductor component with inductance by generating a magnetic flux in the magnetic layer when a current flows therein, and there is no particular limitation regarding the structure, the shape, the material, and the like about the inductor line.

According to the embodiment, the adhesiveness between the insulating layer and the principal surface of the magnetic layer can be suppressed from deteriorating.

Other features, elements, characteristics, and advantages of the present disclosure will become more apparent from the following detailed description of some embodiments of the present disclosure with reference to the attached drawings.

DETAILED DESCRIPTION

An embodiment of an inductor component will be described below. In this regard, some of the accompanying drawings are enlarged views of constituent elements for the sake of facilitating understanding. The dimensional ratios of the constituent elements may differ from the actual dimensional ratios or from the dimensional ratios in other drawings. Meanwhile, sectional views are provided with hatching, but some constituent elements are not hatched for the sake of facilitating understanding.

Figure 1:
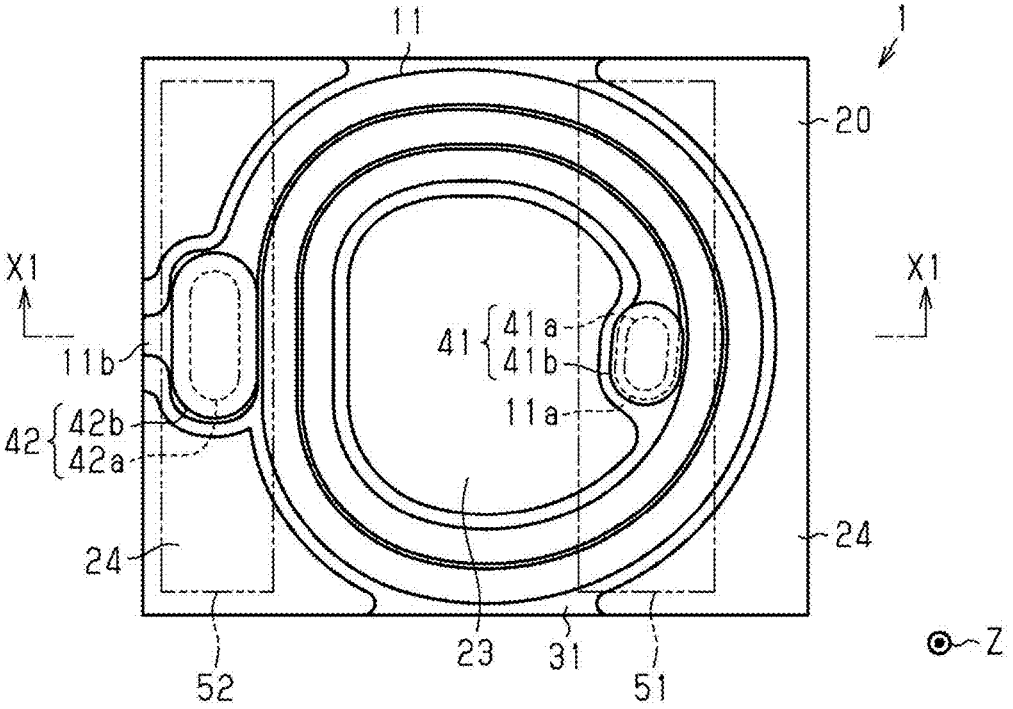
FIG. 1 is a transparent plan view of an inductor component according to an embodiment.

The inductor component 1 illustrated in FIG. 1 is a surface-mount-type inductor component to be mounted on electronic equipment, for example, in personal computers, DVD players, digital cameras, televisions, cellular phones, and car electronics. The inductor component 1 generates impedance in the electronic equipment and has functions of, for example, impedance matching, filtering, resonance, smoothing, rectification, charge, voltage transformation, distribution, coupling, and conversion.

Figure 2:
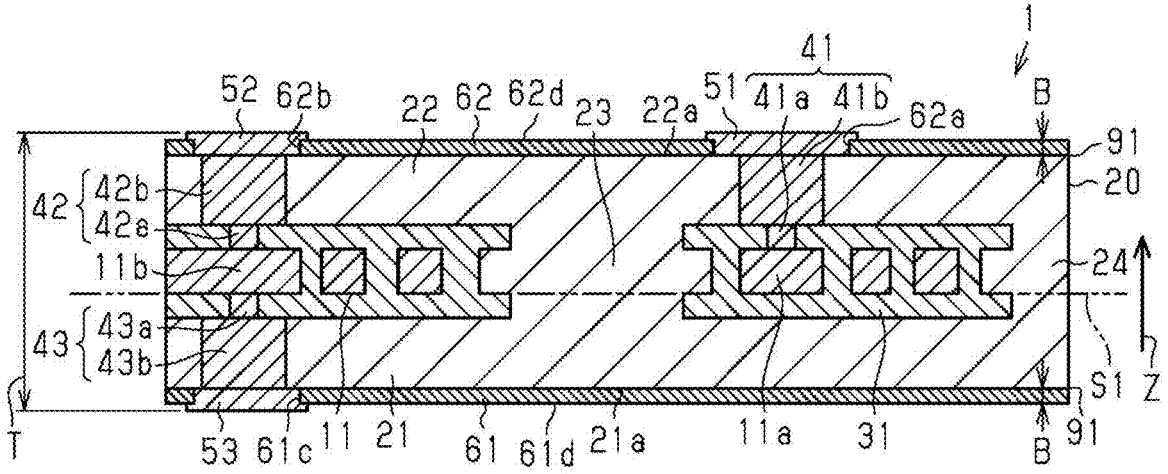
FIG. 2 is a sectional view of an inductor component according to an embodiment (sectional view along line X1-X1 in FIG. 1)
Figure 3:
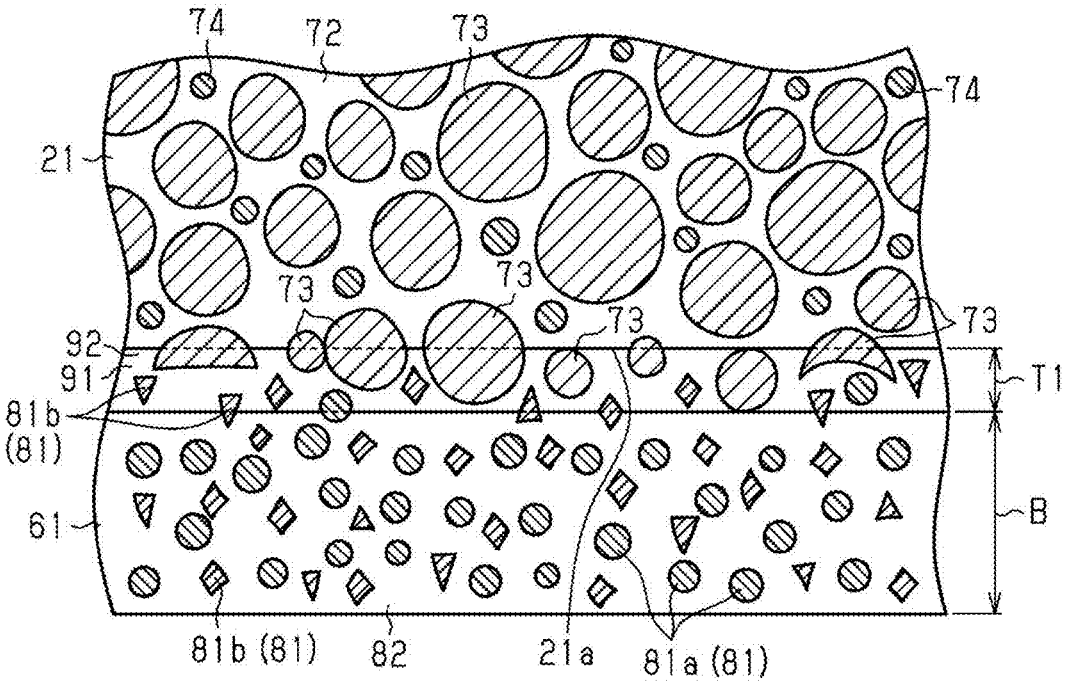
FIG. 3 is an enlarged sectional view of an inductor component according to an embodiment.

As illustrated in FIG. 1 to FIG. 3, the inductor component 1 includes a spiral wiring line 11 which is an example of an inductor wiring line that extends in a plane and magnetic layers 21 and 22 that are formed of an organic resin 72 containing a magnetic powder 73 and that cover the spiral wiring line 11. The inductor component 1 also includes nonmagnetic-body insulating layers 61 and 62 that are formed of an organic resin 82 containing an insulating nonmagnetic powder 81 and that cover the principal surfaces 21*a* and 22*a* of the magnetic layers 21 and 22, respectively. The inductor component 1 further includes close-contact layers 91 that are located between the respective magnetic layers 21 and 22 and the respective insulating layers 61 and 62 and that contain the magnetic powder 73, the nonmagnetic powder 81, and an organic resin 92.

In the present specification, "spiral wiring line" denotes a two-dimensionally curved wiring line that extends in a plane including a virtual plane. The number of turns illustrated by the curve may be more than 1 or less than 1. The wiring line may have a plurality of curves wound in different directions, or the wiring line may partly have linear portions. In this regard, the inductor wiring line is not limited to a spiral wiring line, and known wiring lines having various shapes, for example, meandering wiring lines, may be used.

As illustrated in FIG. 1 and FIG. 2, the inductor component 1 according to the present embodiment has a substantially rectangular parallelepiped shape. In the present specification, "substantially rectangular parallelepiped" includes a case in which some or all of the surfaces have unevenness. Meanwhile, regarding "substantially rectangular parallelepiped" in the present specification, each surface and opposite surfaces thereof are not limited to being completely parallel to each other and may form a small angle (that is, adjacent surfaces are not limited to forming a right angle). In this regard, there is no particular limitation regarding the shape of the inductor component 1, and the inductor component 1 may have substantially the shape of a circular column, a polygonal column, a truncated cone, a truncated pyramid, or the like.

The inductor component 1 includes a spiral wiring line 11, a magnetic body 20, an insulator 31, vertical wiring lines 41, 42, and 43, external terminals 51, 52, and 53, and insulating layers 61 and 62.

The spiral wiring line 11 is formed of a conductive material and is wound in a plane. The direction perpendicular to the plane Si in which the spiral wiring line 11 is wound is denoted as the Z-direction as illustrated in the drawings. The vertical direction in FIG. 2 corresponds to the Z-direction, the forward direction of the Z-direction is denoted as an upward direction, and the opposite direction of the forward direction of the Z-direction is denoted as a downward direction. The Z-direction corresponds to the thickness direction of the inductor component 1. Regarding the Z-direction, the same applies in modified examples. When viewed from above, the spiral wiring line 11 is formed into the shape of a spiral in a counterclockwise direction from the inner circumferential end 11*a* toward the outer circumferential end 11*b*.

In the present embodiment, the number of turns of the spiral wiring line 11 is 2.5 turns. The number of turns of the spiral wiring line 11 is preferably about 5 turns or less. The number of turns being about 5 turns or less enables the loss due to a proximity effect with respect to a high-frequency signal in the range of about 50 MHz to 150 MHz that is input into the inductor component 1 to be reduced. Meanwhile, in the case in which a low frequency signal of about 1 MHz is input into the inductor component 1, the number of turns of the spiral wiring line 11 is preferably about 2.5 turns or more. The number of turns of the spiral wiring line 11 being increased enables the inductance of the inductor component 1 to be increased and enables a ripple current generated in the inductor component 1 to be reduced.

Examples of the material used for forming the spiral wiring line 11 include low-resistance metals such as Cu (copper), Ag (silver), and Au (gold). Preferably, a conductor formed of Cu or a Cu compound is used as the material for forming the spiral wiring line 11. Consequently, the production cost with respect to the spiral wiring line 11 may be reduced and the direct current resistance in the spiral wiring line 11 may be reduced. Meanwhile, it is preferable that the spiral wiring line 11 be composed of copper plating formed by using a semi-additive process (SAP). Consequently, the spiral wiring line 11 having low resistance and a small pitch may be inexpensively obtained. In this regard, the spiral wiring line 11 may be formed by using, for example, a plating method other than a SAP, a sputtering method, an evaporation method, or a coating method.

The magnetic body 20 is formed of a magnetic material. The magnetic body 20 is composed of a first magnetic layer 21, a second magnetic layer 22, an inner magnetic path portion 23, and an outer magnetic path portion 24.

The first magnetic layer 21 and the second magnetic layer 22 are located at positions between which the spiral wiring line 11 is interposed in the Z-direction. Specifically, the first magnetic layer 21 is located under the spiral wiring line 11 so as to cover the spiral wiring line 11 from below, and the second magnetic layer 22 is located on the spiral wiring line 11 so as to cover the spiral wiring line 11 from above. That is, the spiral wiring line 11 is interposed between the first magnetic layer 21 and the second magnetic layer 22. The inner magnetic path portion 23 is arranged inside the spiral wiring line 11. That is, in the magnetic body 20, the inner magnetic path portion 23 is a portion that is disposed inside the spiral wiring line 11 and that is interposed between the first magnetic layer 21 and the second magnetic layer 22. The outer magnetic path portion 24 is arranged outside the spiral wiring line 11. That is, in the magnetic body 20, the outer magnetic path portion 24 is a portion that is disposed outside the spiral wiring line 11 and that is interposed between the first magnetic layer 21 and the second magnetic layer 22. In addition, the inner magnetic path portion 23 and the outer magnetic path portion 24 are connected to the first magnetic layer 21 and the second magnetic layer 22. In this manner, the magnetic body 20 forms a closed magnetic circuit with respect to the spiral wiring line 11. In this regard, as illustrated in FIG. 2, the first magnetic layer 21, the second magnetic layer 22, the inner magnetic path portion 23, and the outer magnetic path portion 24 may be integrated and the boundaries therebetween may be unclear.

As illustrated in FIG. 2 and FIG. 3, the magnetic body 20, that is, each of the first magnetic layer 21, the second magnetic layer 22, the inner magnetic path portion 23, and the outer magnetic path portion 24, is formed of an organic resin 72 containing a magnetic powder 73. In this regard, the organic resin 72 according to the present embodiment further contains a nonmagnetic powder 74. However, the organic resin 72 is not limited to containing the nonmagnetic powder 74.

Preferably, the organic resin 72 contained in the first magnetic layer 21, the second magnetic layer 22, the inner magnetic path portion 23, and the outer magnetic path portion 24 contains at least one resin of an epoxy-based resin and an acrylic resin. However, the organic resin 72 contained in the first magnetic layer 21, the second magnetic layer 22, the inner magnetic path portion 23, and the outer magnetic path portion 24 is not limited to containing at least one resin of the epoxy-based resin and the acrylic resin.

Examples of the material used for forming the magnetic powder 73 include a magnetic metal containing iron (Fe). Regarding Fe, a simple metal may be contained in the magnetic powder 73, or an alloy containing Fe may be contained in the magnetic powder 73. Examples of the material used for forming the magnetic powder 73 containing Fe include Fe—Si-based alloys such as Fe—Si (silicon)-Cr (chromium) alloys, Fe—Co (cobalt)-based alloys, and Fe-based alloys such as NiFe (permalloy) or amorphous alloys of these. In the present embodiment, the magnetic powder 73 is an Fe—Si—Cr alloy powder.

The filling ratio of the magnetic powder 73 in each of the first magnetic layer 21 and the second magnetic layer 22 is preferably about 50% by volume or more and 90% by volume or less (i.e., from about 50% by volume to 90% by volume). Likewise, the filling ratio of the magnetic powder 73 in each of the inner magnetic path portion 23 and the outer magnetic path portion 24 is preferably about 50% by volume or more and 90% by volume or less (i.e., from about 50% by volume to 90% by volume). However, the filling ratio of the magnetic powder 73 in each of the first magnetic layer 21 and the second magnetic layer 22 and the filling ratio of the magnetic powder 73 in each of the inner magnetic path portion 23 and the outer magnetic path portion 24 are not limited to being about 50% by volume or more and 90% by volume or less (i.e., from about 50% by volume to 90% by volume). In this regard, the above-described filling ratio is denoted as the proportion of the volume of the magnetic powder 73, where the denominator is the total volume of the first magnetic layer 21, the second magnetic layer 22, the inner magnetic path portion 23, or the outer magnetic path portion 24. For example, the filling ratio of the magnetic powder 73 in the first magnetic layer 21 is the proportion of the volume of the magnetic powder 73 contained in the first magnetic layer 21, where the denominator is the total volume of the first magnetic layer 21.

The filling ratio of the magnetic powder 73 is measured by observing the magnetic powder 73 in a micrograph of the cross section of each measurement target layer (that is, the first magnetic layer 21, the second magnetic layer 22, the inner magnetic path portion 23, or the outer magnetic path portion 24) obtained by using a scanning electron microscope (SEM). Specifically, regarding five cross sections in the bulk region of each layer (preferably, as close to the center as possible), the average area ratio of the magnetic powder 73 is measured on the basis of the SEM image obtained at a magnification of 10,000 times. The measured average area ratio of the magnetic powder 73 is taken as the filling ratio of the magnetic powder 73.

Silicon dioxide (silica ($SiO_2$)) may be used as the material for forming the nonmagnetic powder 74. The material for forming the nonmagnetic powder 74 contained in the magnetic body 20 is not limited to $SiO_2$, and barium sulfate ($BaSO_4$), boron nitride (BN), and the like may also be used.

In the inductor component 1 according to the present embodiment, the first magnetic layer 21, the second magnetic layer 22, the inner magnetic path portion 23, and the outer magnetic path portion 24 are formed of the same material but may be formed of materials that differ from each other.

As illustrated in FIG. 1 and FIG. 2, the insulator 31 is a member having an electrical insulating property and is arranged between the first magnetic layer 21 and the second magnetic layer 22 and between the magnetic body 20 and the spiral wiring line 11. In the present embodiment, the insulator 31 is arranged between the first magnetic layer 21 and the spiral wiring line 11, between the second magnetic layer 22 and the spiral wiring line 11, between the inner magnetic path portion 23 and the spiral wiring line 11, and between the outer magnetic path portion 24 and the spiral wiring line 11. The insulator 31 is in contact with the spiral wiring line 11 from above, from below, and laterally and, in addition, covers the surfaces of the spiral wiring line 11. The insulator 31 ensures insulation performance between the wiring lines of the spiral wiring line 11. Meanwhile, the first magnetic layer 21 is in contact with the insulator 31 from below (Z-direction), and the second magnetic layer 22 is in contact with the insulator 31 from above (direction opposite to the Z-direction). Therefore, the surfaces of the insulator 31 are covered with the magnetic body 20. In this regard, as illustrated in FIG. 2, the insulator 31 may be partly exposed at the magnetic body 20, or the insulator 31 may be entirely covered with the magnetic body 20.

The insulator 31 is formed of a nonmagnetic insulating material. In the present embodiment, the insulator 31 is formed by using an insulating resin formed of an organic resin containing an inorganic powder. Regarding FIG. 1, the magnetic body 20 and the insulator 31 shown in the drawing are transparent. However, the magnetic body 20 and the insulator 31 may be transparent, translucent, or opaque. In addition, the magnetic body 20 and the insulator 31 may be colored.

Examples of the material used for forming the insulator 31 include organic resins containing a $SiO_2$ powder. However, the insulator 31 is not limited to containing a $SiO_2$ powder. Meanwhile, the resin contained in the insulator 31 has to be an insulating resin and preferably contains at least an epoxy-based resin, an acrylic resin, a phenolic resin, a polyimide-based resin, or a liquid-crystal-polymer-based resin.

The vertical wiring lines 41 to 43 are formed of a conductive material. Each of the vertical wiring lines 41 to 43 extends through the magnetic body 20 from the spiral wiring line 11 to the surface of the magnetic body 20 in the stacking direction of the first magnetic layers 21 and 22 in the magnetic body 20. In this regard, the surface of the magnetic body 20 is the face of the magnetic body 20 that faces away from the inductor component 1.

The first vertical wiring line 41 and the second vertical wiring line 42 extend through the second magnetic layer 22 from the spiral wiring line 11 in the Z-direction. The first vertical wiring line 41 includes a first via conductor 41*a* that extends upward from the upper surface of the inner circumferential end 11*a* of the spiral wiring line 11 through the insulator 31 in the Z-direction and a first columnar wiring line 41*b* that extends upward from the first via conductor 41*a* through the second magnetic layer 22 in the Z-direction. The second vertical wiring line 42 includes a second via conductor 42*a* that extends upward from the upper surface of the outer circumferential end 11*b* of the spiral wiring line 11 through the insulator 31 in the Z-direction and a second columnar wiring line 42*b* that extends upward from the second via conductor 42*a* through the second magnetic layer 22 in the Z-direction.

The third vertical wiring line 43 extends through the first magnetic layer 21 from the spiral wiring line 11 in the direction opposite to the Z-direction. The third vertical wiring line 43 includes a third via conductor 43*a* that extends downward from the lower surface of the outer circumferential end 11*b* of the spiral wiring line 11 through the insulator 31 in the direction opposite to the Z-direction and a third columnar wiring line 43*b* that extends downward from the third via conductor 43*a* through the first magnetic layer 21 in the direction opposite to the Z-direction. The second vertical wiring line 42 and the third vertical wiring line 43 are located at positions with the spiral wiring line 11 interposed therebetween in the Z-direction.

Examples of the material used for forming the vertical wiring lines 41 to 43 (via conductors 41*a* to 43*a* and columnar wiring lines 41*b* to 43*b*) include low-resistance metals such as Cu, Ag, and Au. Preferably, a conductor formed of Cu or a Cu compound is used as the material for forming the vertical wiring lines 41 to 43. Consequently, the production cost with respect to the vertical wiring lines 41 to 43 may be reduced and the direct current resistance in the vertical wiring lines 41 to 43 may be reduced. Meanwhile, it is preferable that the vertical wiring lines 41 to 43 be formed of copper plating formed by using a SAP. Consequently, the vertical wiring lines 41 to 43 having low resistance may be inexpensively obtained. In this regard, the vertical wiring lines 41 to 43 may be formed by using, for example, a plating method other than a SAP, a sputtering method, an evaporation method, or a coating method.

The external terminals 51 to 53 are formed of a conductive material. The external terminals 51 to 53 are disposed on the principal surfaces 21*a* and 22*a* of the magnetic layers 21 and 22, respectively. The external terminals 51 to 53 are arranged on the end surfaces of the vertical wiring lines 41 to 43 exposed at the principal surfaces 21*a* and 22*a* of the magnetic layers 21 and 22, respectively.

In this disclosure, "principal surface" denotes the face that faces away from the inductor component 1 in the Z-direction and is the end surface of each of the first magnetic layers 21 and 22 in the stacking direction, for example. Specifically, the principal surface 21*a* of the first magnetic layer 21 is the lower surface of the first magnetic layer 21, and the principal surface 22*a* of the second magnetic layer 22 is the upper surface of the second magnetic layer 22. Regarding the structure in which a plurality of magnetic layers including the inner magnetic path portion 23 and the outer magnetic path portion 24 are stacked, the interface between the magnetic layers are not denoted as the "principal surface".

In the case in which the vertical wiring lines 41 to 43 are exposed at the principal surfaces 21*a* and 22*a* of the magnetic layers 21 and 22, respectively, exposure is not limited to being complete exposure to outside the inductor component 1 and exposure at only the magnetic body 20 is necessary. That is, "exposure" includes the case in which the vertical wiring lines 41 to 43 are exposed at the magnetic body 20 and to other members. Therefore, portions of the vertical wiring lines 41 to 43 exposed at the magnetic body 20 may be covered by other members such as insulating coating films (for example, insulating layers 61 and 62) and electrodes (for example, external terminals 51 to 53).

The first external terminal 51 is disposed on the principal surface 22*a* of the second magnetic layer 22 and covers the end surface of the first vertical wiring line 41 (that is, the upper end surface of the first columnar wiring line 41*b*) exposed at the principal surface 22*a*. The second external terminal 52 is disposed on the principal surface 22*a* of the second magnetic layer 22 and covers the end surface of the second vertical wiring line 42 (that is, the upper end surface of the second columnar wiring line 42*b*) exposed at the principal surface 22*a*. The third external terminal 53 is disposed on the principal surface 21*a* of the first magnetic layer 21 and covers the end surface of the third vertical wiring line 43 (that is, the lower end surface of the third columnar wiring line 43*b*) exposed at the principal surface 21*a*. The second external terminal 52 and the third external terminal 53 are located at positions with the spiral wiring line 11 interposed therebetween in the Z-direction.

Examples of the material used for forming the external terminals 51 to 53 include low-resistance metals such as Cu, Ag, and Au. Preferably, a conductor formed of Cu or a Cu compound is used as the material for forming the external terminals 51 to 53. Consequently, the production cost with respect to the external terminals 51 to 53 may be reduced and the direct current resistance in the external terminals 51 to 53 may be reduced. In this regard, the material for forming the spiral wiring line 11, the vertical wiring lines 41 to 43, and the external terminals 51 to 53 being a conductor that is composed mainly of Cu enables the adhesion force and the electrical conductivity between the spiral wiring line 11 and the vertical wiring lines 41 to 43 and between the vertical wiring lines 41 to 43 and the external terminals 51 to 53 to be enhanced. Meanwhile, it is preferable that the external terminals 51 to 53 be copper formed by electroless plating. Consequently, the external terminals 51 to 53 may be readily formed with a small thickness. In this regard, the external terminals 51 to 53 may be formed by using, for example, a plating method other than electroless plating, a sputtering method, an evaporation method, or a coating method.

Preferably, each of the external terminals 51 to 53 is subjected to rustproofing. In this regard, rustproofing denotes formation of a coating film of nickel (Ni), gold (Au), tin (Sn), or the like on the surface. Consequently, since copper leaching by solder, rust, ion migration, and the like can be suppressed from occurring, the mounting reliability of the inductor component 1 can be enhanced.

In this regard, only the first magnetic layer 21 or only the second magnetic layer 22 may have the vertical wiring lines 41 to 43 and the external terminals 51 to 53. Meanwhile, a dummy terminal that is not electrically coupled to the spiral wiring line 11 and that serves as an external terminal may be disposed on the principal surface 21*a* of the first magnetic layer 21 or the principal surface 22*a* of the second magnetic layer 22. Since the dummy terminal is electrically conductive, the thermal conductivity is high. Therefore, since the heat dissipation effect of the inductor component 1 can be improved, the reliability of the inductor component 1 can be enhanced (high environmental tolerance is obtained).

As illustrated in FIG. 2, the first insulating layer 61 covers the principal surface 21*a* of the first magnetic layer 21. The second insulating layer 62 covers the principal surface 22*a* of the second magnetic layer 22. In this regard, the insulating layers 61 and 62 are omitted from FIG. 1. Regarding the principal surface 21*a*, the first insulating layer 61 covers a region excluding the third external terminal 53 and exposes the lower end surface of the third external terminal 53. Regarding the principal surface 22*a*, the second insulating layer 62 covers a region excluding the first external terminal 51 and the second external terminal 52 and exposes the upper end surface of the first external terminal 51 and the upper end surface of the second external terminal 52.

In the inductor component 1 according to the present embodiment, the surfaces of the external terminals 51 and 52 are located at positions outward of the principal surface 22*a* of the second magnetic layer 22 in the Z-direction, and the surface of the external terminal 53 is located at a position outward of the principal surface 21*a* of the first magnetic layer 21 in the direction opposite to the Z-direction. Therefore, the surfaces of the external terminals 51 and 52 are not flush with the principal surface 22*a* of the second magnetic layer 22, and the surface of the external terminal 53 is not flush with the principal surface 21*a* of the first magnetic layer 21. In the present embodiment, the surfaces of the external terminals 51 and 52 are located at positions outward of the principal surface 62*d* (upper surface) of the second insulating layer 62 in the Z-direction, and the surface of the external terminal 53 is located at a position outward of the principal surface 61*d* (lower surface) of the first insulating layer 61 in the direction opposite to the Z-direction. Since the positional relationship between the principal surface 21*a* of the first magnetic layer 21 and the surface of the external terminal 53 and the positional relationship between the principal surface 22*a* of the second magnetic layer 22 and the surfaces of the external terminals 51 and 52 can be independently set, the degree of thickness leeway of the external terminals 51 to 53 can be increased. In addition, since the height positions of the surfaces of the external terminals 51 to 53 in the inductor component 1 can be adjusted, for example, in the case in which the inductor component 1 is embedded in a substrate, the height positions of the surfaces of the external terminals 51 to 53 can be made equal to the height position of the external terminal of another embedded component. Therefore, using such an inductor component 1 enables the focusing step of a laser during via formation of a substrate to be streamlined and, thereby, enables the production efficiency of the substrate incorporated with the inductor component 1 to be improved.

As illustrated in FIG. 1 and FIG. 2, in the inductor component 1 according to the present embodiment, the areas of the external terminals 51 to 53 that cover the end surfaces of the vertical wiring lines 41 to 43, respectively (the end surfaces of the columnar wiring lines 41*b* to 43*b*, respectively), are larger than the areas of the vertical wiring lines 41 to 43, respectively, when viewed in the Z-direction. Therefore, since the bonding areas during mounting increase, the mounting reliability of the inductor component 1 can be improved. When mounting on the substrate is performed, regarding the bonding position of the substrate wiring line and the inductor component 1, an alignment margin can be ensured, and, thereby, the mounting reliability can also be improved. Since the mounting reliability can be improved regardless of the volumes of the columnar wiring lines 41*b* to 43*b*, reducing the cross-sectional areas of the columnar wiring lines 41*b* to 43*b* in the Z-direction enables the volume of the first magnetic layer 21 or the second magnetic layer 22 to be suppressed from being reduced and enables the characteristics of the inductor component 1 to be suppressed from deteriorating.

Figure 5:
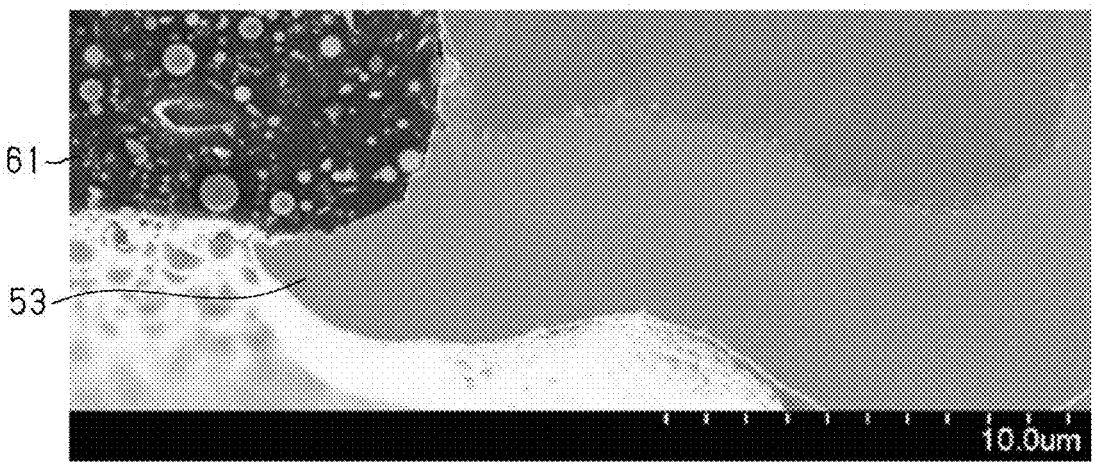
FIG. 5 is a sectional photograph of an inductor component according to an embodiment.

As illustrated in FIG. 2 and FIG. 5, the external terminals 51 and 52 cover a part of the principal surface 62*d* of the second insulating layer 62. The external terminal 53 covers a part of the principal surface 61*d* of the first insulating layer 61. In this regard, the principal surfaces 61*d* and 62*d* of the insulating layers 61 and 62, respectively, are outer surfaces that face away from the inductor component 1 in the Z-direction.

In the present embodiment, the second insulating layer 62 has a cavity 62*a* larger than the upper end surface of the first vertical wiring line 41 at a position corresponding to the upper end surface of the first vertical wiring line 41 and has a cavity 62*b* larger than the upper end surface of the second vertical wiring line 42 at a position corresponding to the upper end surface of the second vertical wiring line 42. The first external terminal 51 is disposed so that the cavity 62*a* is filled with the first external terminal 51, and the second external terminal 52 is disposed so that the cavity 62*b* is filled with the second external terminal 52. The surfaces of the first external terminal 51 and the second external terminal 52 are located at positions outward of the principal surface 62*d* of the second insulating layer 62 in the Z-direction. Further, in the first external terminal 51, the portion located at a position outward of the principal surface 62*d* of the second insulating layer 62 in the Z-direction has a larger external shape than the cavity 62*a* and covers the outer circumferential portion of the cavity 62*a* of the principal surface 62*d*. Likewise, in the second external terminal 52, the portion located at a position outward of the principal surface 62*d* of the second insulating layer 62 in the Z-direction has a larger external shape than the cavity 62*b* and covers the outer circumferential portion of the cavity 62*b* of the principal surface 62*d*. The second insulating layer 62 is interposed between the second magnetic layer 22 and the portions in the external terminals 51 and 52 that are located at positions outward of the principal surface 62*d* of the second insulating layer 62 in the Z-direction. The first insulating layer 61 has a cavity 61*c* larger than the lower end surface of the third vertical wiring line 43 at a position corresponding to the lower end surface of the third vertical wiring line 43. The third external terminal 53 is disposed so that the cavity 61*c* is filled with the third external terminal 53. The surface of the third external terminal 53 is located at a position outward of the principal surface 61*d* of the first insulating layer 61 in the direction opposite to the Z-direction. Further, in the third external terminal 53, the portion located at a position outward of the principal surface 61*d* of the first insulating layer 61 in the direction opposite to the Z-direction has a larger external shape than the cavity 61*c* and covers the outer circumferential portion of the cavity 61*c* of the principal surface 61*d*. The first insulating layer 61 is interposed between the first magnetic layer 21 and the portion in the external terminal 53 that is located at a position outward of the principal surface 61*d* of the first insulating layer 61 in the direction opposite to the Z-direction.

In the present embodiment, the external terminals 51 and 52 cover the entire outer circumferential portion of each of the cavities 62*a* and 62*b*, respectively, of the principal surface 62*d* of the second insulating layer 62 but may cover only part of the respective circumferential portions. Likewise, the external terminal 53 covers the entire circumferential portion of the cavity 61*c* of the principal surface 61*d* of the first insulating layer 61 but may cover only part of the circumferential portion. The external terminals 51 to 53 are not limited to covering the principal surfaces 61*d* and 62*d* of the insulating layers 61 and 62, respectively.

As illustrated in FIG. 2 and FIG. 3, where T represents the thickness of the inductor component 1, the thickness B of each of the insulating layers 61 and 62 is preferably T/100 or more and T/20 or less (i.e., from T/100 to T/20). In the case in which the thickness T of the inductor component 1 is, for example, about 140 to 700 μm, the thickness B of each of the insulating layers 61 and 62 is set to be, for example, preferably about 7 μm. However, the thickness T of the inductor component 1 is not limited to this.

The first insulating layer 61 is a nonmagnetic body that covers the principal surface 21*a* of the first magnetic layer 21. The second insulating layer 62 is a nonmagnetic body that covers the principal surface 22*a* of the second magnetic layer 22. In this regard, the nonmagnetic body does not contain a magnetic powder. The insulating layers 61 and 62 are formed of an organic resin 82 containing an insulating nonmagnetic powder 81, and the organic resin 82 does not contain a magnetic powder. Examples of the organic resin 82 include insulating organic resins such as epoxy-based resins, phenolic resins, and polyimide-based resins. The insulating layers 61 and 62 are formed of a photosensitive resist or a solder resist composed of the organic resin 82 containing the nonmagnetic powder 81.

The nonmagnetic powder 81 contained in the insulating layers 61 and 62 may be composed of a single nonmagnetic powder but is preferably composed of a plurality of nonmagnetic powders. Of the plurality of types in the nonmagnetic powder 81, it is preferable that at least one nonmagnetic powder contain silicon (Si) and oxygen (O). Of the plurality of types in the nonmagnetic powder 81, it is preferable that at least one nonmagnetic powder contain barium (Ba) and sulfur (S). However, the nonmagnetic powder 81 is not limited to containing Si and O. In addition, the nonmagnetic powder 81 is not limited to containing Ba and S.

In the present embodiment, the nonmagnetic powder 81 is composed of two types, a nonmagnetic powder 81*a* and a nonmagnetic powder 81*b*. However, the nonmagnetic powder 81 is not limited to being composed of two types and may be composed of three or more types. The nonmagnetic powder 81*a* is formed of $SiO_2$ and has particles with a substantially spherical shape. However, the nonmagnetic powder 81*a* is not limited to having particles with a substantially spherical shape. The nonmagnetic powder 81*b* is formed of barium sulfate ($BaSO_4$). The nonmagnetic powder 81*b* is a pulverized filler and has particles with a nonspherical shape. In the present specification, "nonspherical shape" includes a spherical shape that is partly indented and a shape that is not composed of only a smooth surface and that has a protruding portion. The nonmagnetic powder 81*b* is not limited to having particles with a nonspherical shape.

In the present embodiment, two types, nonmagnetic powders 81*a* and 81*b*, of the plurality of types in the nonmagnetic powder 81 differ from each other in particle dimension by a factor of about 1.5 or more. Specifically, the nonmagnetic powder 81*a* formed of $SiO_2$ has a particle dimension about 1.5 times or more the particle dimension of the nonmagnetic powder 81*b* formed of $BaSO_4$. In FIG. 3, the nonmagnetic powder 81*b* particles are exaggerated in size, and the dimensional relationship between the nonmagnetic powder 81*a* particles and the nonmagnetic powder 81*b* particles illustrated in FIG. 3 is different from the actual dimensional relationship. In this regard, the dimensional difference can be determined by, for example, comparing the maximum dimension of the external shape of a particle of the nonmagnetic powder. In addition, the dimensional difference can also be determined by using any one of the dimension in the longitudinal direction, the dimension in the lateral direction, the diameter, and the like that can be measured. Of the plurality of types in the nonmagnetic powder 81, two types, the nonmagnetic powders 81*a* and 81*b*, may differ from each other in particle dimension by a factor of less than about 1.5.

Figure 4:
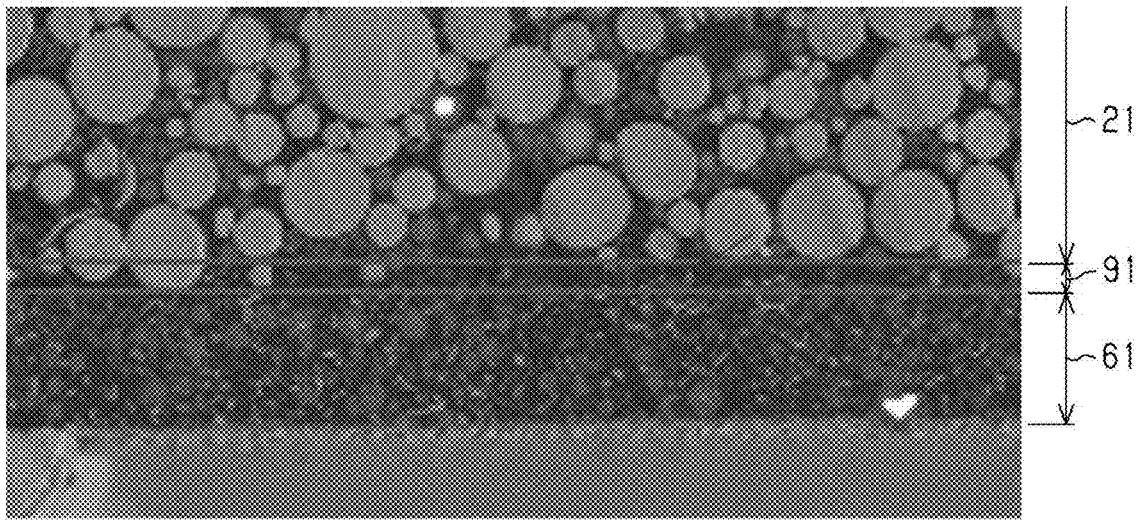
FIG. 4 is a sectional photograph of an inductor component according to an embodiment.

As illustrated in FIG. 2 to FIG. 4, the close-contact layer 91 is located between the first magnetic layer 21 and the first insulating layer 61 covering the principal surface 21*a* of the first magnetic layer 21 and between the second magnetic layer 22 and the second insulating layer 62 covering the principal surface 22*a* of the second magnetic layer 22. FIG. 3 shows the close-contact layer 91 between the first magnetic layer 21 and the first insulating layer 61. Although an enlarged view such as in FIG. 3 is not provided, the same close-contact layer 91 is present between the second magnetic layer 22 and the second insulating layer 62. The close-contact layer 91 located between the first magnetic layer 21 and the first insulating layer 61 is in close contact with the lower surface (principal surface 21*a*) of the first magnetic layer 21 and the upper surface of the first insulating layer 61. The close-contact layer 91 located between the second magnetic layer 22 and the second insulating layer 62 is in close contact with the upper surface (principal surface 22*a*) of the second magnetic layer 22 and the lower surface of the second insulating layer 62.

The close-contact layer 91 contains the magnetic powder 73, the nonmagnetic powder 81, and the organic resin 92. The organic resin 92 contains the organic resin 72 included in the first magnetic layer 21 and the second magnetic layer 22 and the organic resin 82 included in the insulating layers 61 and 62. The magnetic powder 73 contained in the close-contact layer 91 is the same as the magnetic powder 73 contained in the first magnetic layer 21 and the second magnetic layer 22. The nonmagnetic powder 81 contained in the close-contact layer 91 is the same as the nonmagnetic powder 81 contained in the insulating layers 61 and 62.

Therefore, in the present embodiment, the magnetic powder 73 contained in the close-contact layer 91 is an Fe—Si—Cr alloy powder. The nonmagnetic powder 81 in the close-contact layer 91 contains two different types of particles in terms of material, the nonmagnetic powder 81*a* and the nonmagnetic powder 81*b*. The nonmagnetic powder 81*a* is formed of $SiO_2$ and has particles with a substantially spherical shape. The nonmagnetic powder 81*b* is formed of $BaSO_4$, is a pulverized filler, and has particles with a nonspherical shape. In the present specification, the nonmagnetic powder 81 in the close-contact layer 91 contains two types of particles, the nonmagnetic powders 81*a* and 81*b*, different from each other in particle dimension by a factor of about 1.5 or more. Specifically, the nonmagnetic powder 81*a* formed of $SiO_2$ has a particle dimension about 1.5 times or more the particle dimension of the nonmagnetic powder 81*b* formed of $BaSO_4$.

Preferably, the magnetic powder 73 in the close-contact layer 91 contains a type of particles having a nonspherical shape (for example, a spherical shape that is partly indented (a hemispherical shape or the like)). However, the magnetic powder 73 contained in the close-contact layer 91 is not limited to including particles having a nonspherical shape.

The filling ratio of the magnetic powder 73 contained in the close-contact layer 91 disposed between the first magnetic layer 21 and the first insulating layer 61 decreases with increasing proximity to the first insulating layer 61 from the first magnetic layer 21 in the direction opposite to the Z-direction (that is, in the thickness direction of the inductor component 1). Likewise, the filling ratio of the magnetic powder 73 contained in the close-contact layer 91 disposed between the second magnetic layer 22 and the second insulating layer 62 decreases with increasing proximity to the second insulating layer 62 from the second magnetic layer 22 in the Z-direction. In each of the close-contact layers 91, the filling ratio of the magnetic powder 73 in the overall close-contact layer 91 is preferably about 1% by volume or more and 60% by volume or less (i.e., from about 1% by volume to 60% by volume).

The thickness T1 of the close-contact layer 91 illustrated in FIG. 3 is preferably about 0.1 μm or more and 5 μm or less (i.e., from about 0.1 μm to 5 μm). However, the thickness T1 of the close-contact layer 91 may be about less than 0.1 μm or may be more than about 5 μm. In this regard, the thickness T1 of the close-contact layer 91 is preferably about 1/10 times or more and 1/3 times or less (i.e., from about 1/10 times to 1/3 times) the thickness B of each of the insulating layers 61 and 62. For example, in the case in which the thickness B of the first insulating layer 61 is, for example, 7 μm, the thickness T1 of the close-contact layer 91 located between the first magnetic layer 21 and the first insulating layer 61 is set to be preferably, for example, 1.13 μm. The same applies to the close-contact layer 91 located between the second magnetic layer 22 and the second insulating layer 62. The thickness T1 of the close-contact layer 91 may be less than about 1/10 times or may be more than 1/3 times the thickness B of each of the insulating layers 61 and 62.

The magnetic powder ratio of the close-contact layer 91 between the first magnetic layer 21 and the first insulating layer 61 and between the second magnetic layer 22 and the second insulating layer 62 are within the range of about 0.3 or more and 0.8 or less (i.e., from about 0.3 to 0.8), where the magnetic powder ratio in the first magnetic layer 21 or the second magnetic layer 22 is assumed to be 1.

Figure 6:
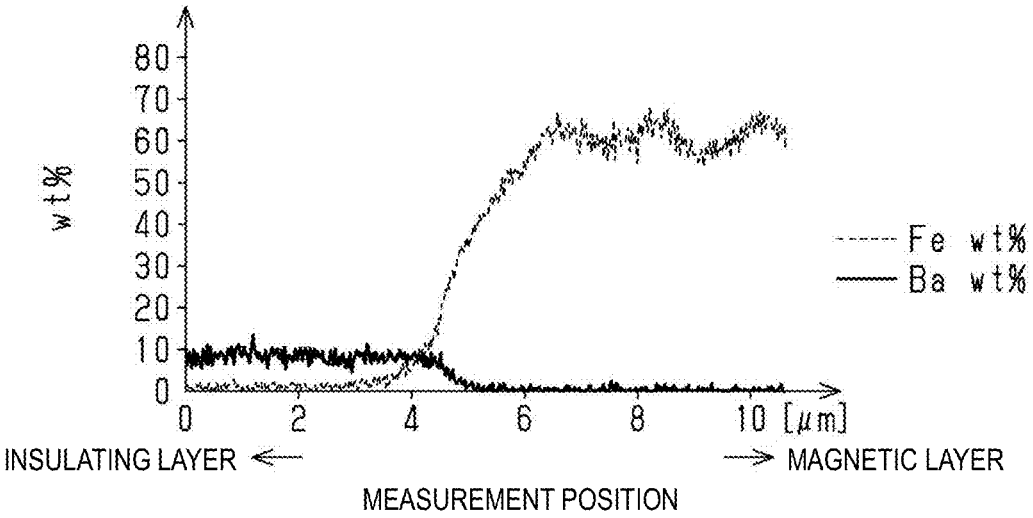
FIG. 6 is a graph showing the results of EDX analysis of an inductor component according to an embodiment.
Figure 7:
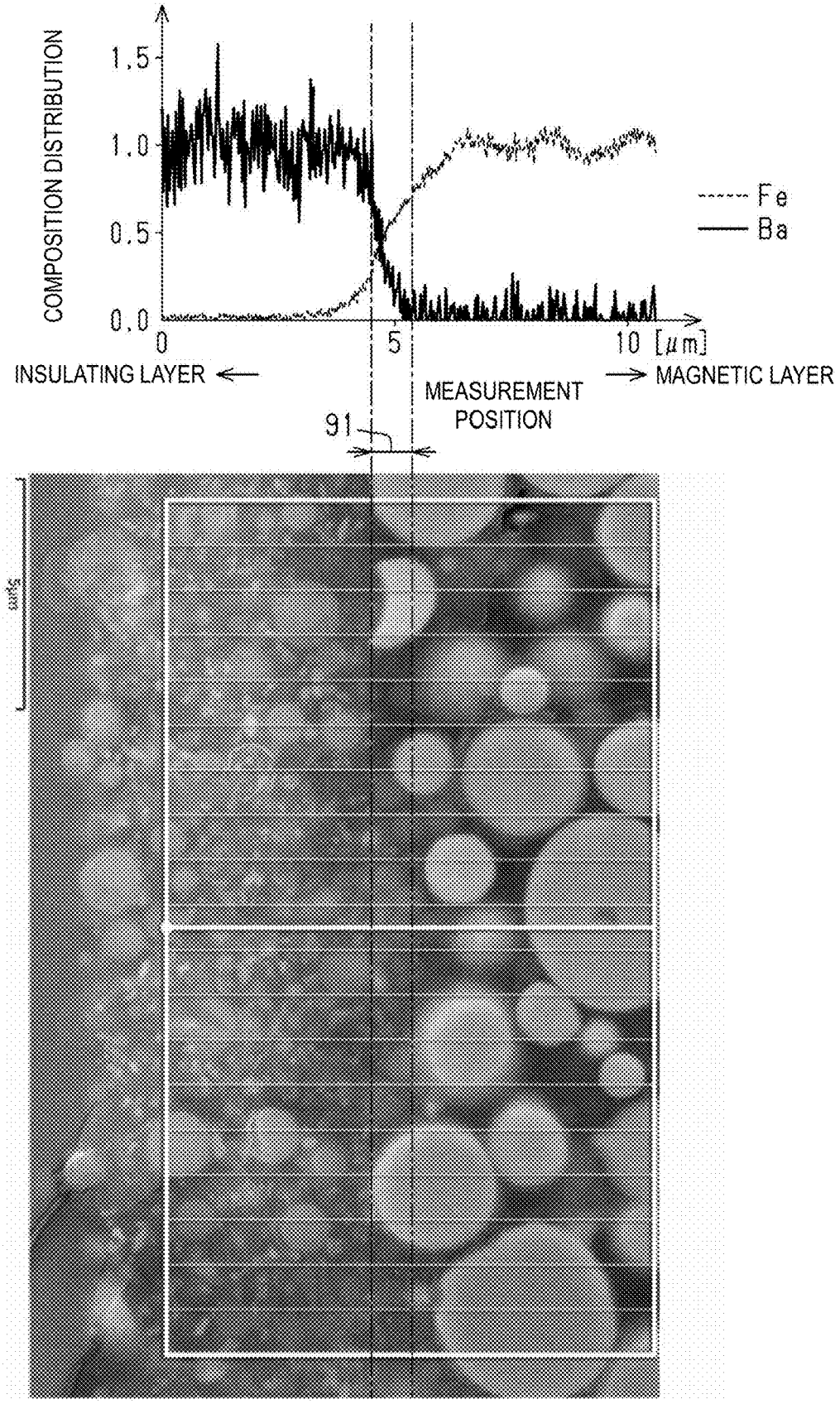
FIG. 7 is an explanatory diagram illustrating a close-contact layer in an inductor component according to an embodiment.

As illustrated in FIG. 6 and FIG. 7, the region of the close-contact layer 91 located between the first magnetic layer 21 and the first insulating layer 61 was examined by performing energy dispersive X-ray spectrometry (EDX analysis) in the direction perpendicular to the principal surface 21*a* of the first magnetic layer 21 (Z-direction in FIG. 2). The EDX analysis was performed at a plurality of positions in the region in which both the first magnetic layer 21 and the first insulating layer 61 were present in a direction parallel to the principal surface 21*a* in the inductor component 1. Specifically, line analysis of the composition was performed at 20 positions at an interval of about 1 μm (area of about 19 μm) in the direction perpendicular to the principal surface 21*a* in the inductor component 1 so as to acquire 20 line analysis data of the composition. As illustrated in FIG. 6, average values of 20 line analysis data were plotted. Since the magnetic powder 73 contained in the first magnetic layer 21 in the present embodiment was an Fe—Si—Cr alloy powder, Fe was focused and plotted. Regarding the nonmagnetic powder 81 contained in the first insulating layer 61, a Ba component (Ba component of $BaSO_4$ in nonmagnetic powder 81*b*) contained in the insulating layers 61 and 62 only was focused and plotted. As illustrated in FIG. 7, the composition distribution data were acquired, where the magnetic powder ratio (average value) in the first magnetic layer 21 was assumed to be 1. On the basis of the resulting composition distribution data, the region which was between the first magnetic layer 21 and the first insulating layer 61 and in which the magnetic powder ratio was 0.3 or more and 0.8 or less (i.e., from 0.3 to 0.8), that is, the region of the close-contact layer 91 located between the first magnetic layer 21 and the first insulating layer 61 was obtained. Consequently, it was ascertained that there was the close-contact layer 91 having a thickness T1 of 1.126 μm and adjoining the first insulating layer 61 having a thickness B of 7±2 μm in the inductor component 1. The thickness T1 of the close-contact layer 91 was 1/6.2 times the thickness B of the first insulating layer 61. Referring to the graph illustrated in FIG. 7, it is ascertained that the Ba component contained in the nonmagnetic powder 81 (specifically, nonmagnetic powder 81*b*) is included in the close-contact layer 91.

Regarding the close-contact layer 91 located between the second magnetic layer 22 and the second insulating layer 62, ascertainment can be performed by using the same method as above.

The graph in FIG. 6 shows the relationship between positions in the thickness direction of the first insulating layer 61, the close-contact layer 91, and the first magnetic layer 21 and the filling ratio (wt %) of the Fe component and the filling ratio (wt %) of the Ba component in each layer (first insulating layer 61, close-contact layer 91, or first magnetic layer 21). Referring to FIG. 6 and FIG. 7, it is ascertained that, in the close-contact layer 91, the filling ratio of the Fe component contained in the magnetic powder 73, that is, the filling ratio of the magnetic powder 73, gradually decreases with increasing proximity to the first insulating layer 61 from the first magnetic layer 21.

As illustrated in FIG. 2 and FIG. 3, particles of the magnetic powder 73 that extend over both the close-contact layer 91 and the first magnetic layer 21 are present in the boundary portion between the close-contact layer 91 and the first magnetic layer 21. The adhesiveness between the close-contact layer 91 and the principal surface 21*a* of the first magnetic layer 21 is improved due to the anchor effect resulting from the magnetic powder 73. Meanwhile, particles of the nonmagnetic powder 81 that extend over both the first insulating layer 61 and the close-contact layer 91 are present in the boundary portion between the first insulating layer 61 and the close-contact layer 91. The adhesiveness between the first insulating layer 61 and the close-contact layer 91 is improved due to the anchor effect resulting from the nonmagnetic powder 81. Consequently, the principal surface 21*a* of the first magnetic layer 21 and the first insulating layer 61 are in close contact with each other with the close-contact layer 91 interposed therebetween.

Likewise, particles of the magnetic powder 73 that extend over both the close-contact layer 91 and the second magnetic layer 22 are present in the boundary portion between the close-contact layer 91 and the second magnetic layer 22. The adhesiveness between the close-contact layer 91 and the principal surface 22*a* of the second magnetic layer 22 is improved due to the anchor effect resulting from the magnetic powder 73. Meanwhile, particles of the nonmagnetic powder 81 that extend over both the second insulating layer 62 and the close-contact layer 91 are present in the boundary portion between the second insulating layer 62 and the close-contact layer 91. The adhesiveness between the second insulating layer 62 and the close-contact layer 91 is improved due to the anchor effect resulting from the nonmagnetic powder 81. Consequently, the principal surface 22*a* of the second magnetic layer 22 and the second insulating layer 62 are in close contact with each other with the close-contact layer 91 interposed therebetween.

The chip size of the inductor component 1 having the above-described configuration according to the present embodiment is, for example, about 1.3 mm×1.6 mm. However, the chip size of the inductor component 1 is not limited to this and may be appropriately changed.

The inductor component 1 according to the present embodiment is a surface-mount-type component which is mounted on the surface of a substrate but may be a flush-type component which is mounted by being embedded in a hole formed in a substrate. The inductor component 1 may be used as a three-dimensional connection component which is incorporated in integrated circuit (IC) packages such as semiconductor packages. For example, the inductor component 1 may be mounted on a substrate included in an IC package or mounted by being embedded in a hole formed in the substrate.

In the present embodiment, the external terminal 53 is disposed on the first magnetic layer 21 side. However, in the case in which the external terminal 53 is not disposed on the first magnetic layer 21 side, the first insulating layer 61 may be skipped.

Manufacturing Method

Next, a method for manufacturing the inductor component 1 will be described.

Figure 8:
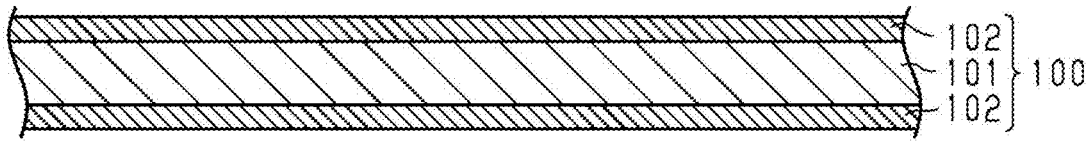
FIG. 8 is an explanatory diagram illustrating a production step of an inductor component according to an embodiment.

As illustrated in FIG. 8, a dummy core substrate 100 is prepared. The dummy core substrate 100 includes an insulating substrate 101 and base metal layers 102 disposed on both surfaces of the insulating substrate 101. In the present embodiment, the insulating substrate 101 is a glass epoxy substrate, and the base metal layer 102 is Cu foil. Since the thickness of the dummy core substrate 100 has no influence on the thickness of the inductor component 1, the dummy core substrate 100 having an easy-to-handle thickness may be appropriately used because of warp during processing and the like.

Figure 9:
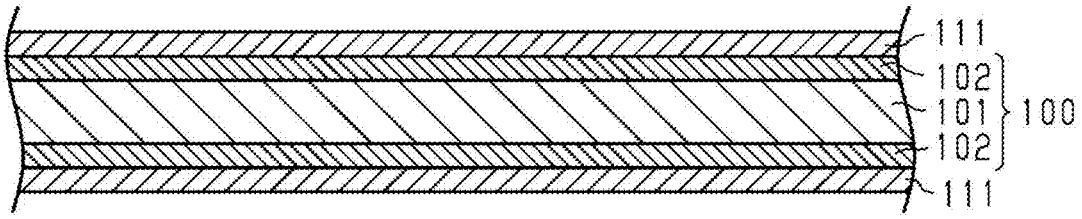
FIG. 9 is an explanatory diagram illustrating a production step of an inductor component according to an embodiment.

As illustrated in FIG. 9, a dummy metal layer 111 is bonded to each base metal layer 102. In the present embodiment, the dummy metal layer 111 is Cu foil. Since the dummy metal layer 111 is bonded to the smooth surface of the base metal layer 102, the bonding power between the dummy metal layer 111 and the base metal layer 102 is made to be low. Therefore, the dummy core substrate 100 can readily be peeled off the dummy metal layer 111 in a downstream step. Preferably, the adhesive for bonding the base metal layer 102 of the dummy core substrate 100 to the dummy metal layer 111 is a pressure-sensitive adhesive with low adhesion. In addition, to reduce the bonding power between the base metal layer 102 and the dummy metal layer 111, it is preferable that the bonding surface between the base metal layer 102 and the dummy metal layer 111 be a glossy surface.

Figure 10:
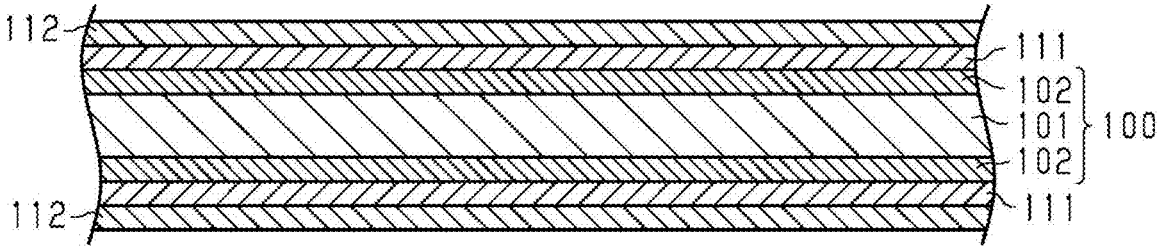
FIG. 10 is an explanatory diagram illustrating a production step of an inductor component according to an embodiment.

As illustrated in FIG. 10, an insulator 112 is stacked on the dummy metal layer 111. The insulator 112 is thermocompression-bonded to the dummy metal layer 111 by using a vacuum laminator, a pressing machine, or the like and, thereafter, is heat-cured.

Figure 11:
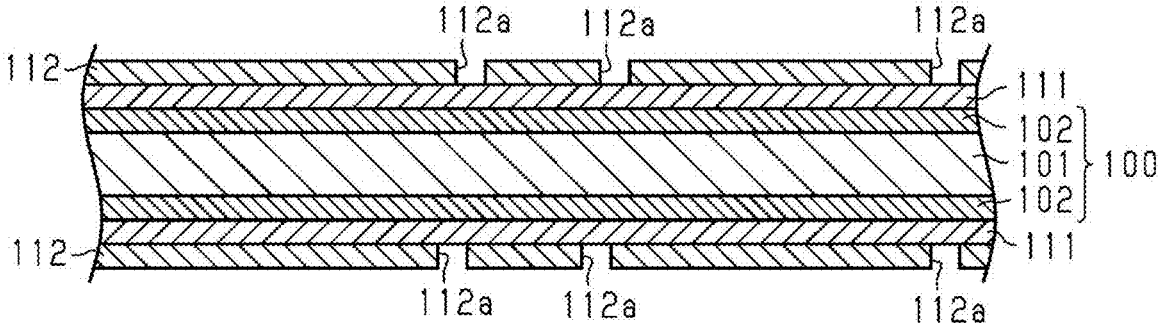
FIG. 11 is an explanatory diagram illustrating a production step of an inductor component according to an embodiment.

As illustrated in FIG. 11, cavities 112*a* are formed in the insulator 112 by laser beam machining or the like.

Figure 12:
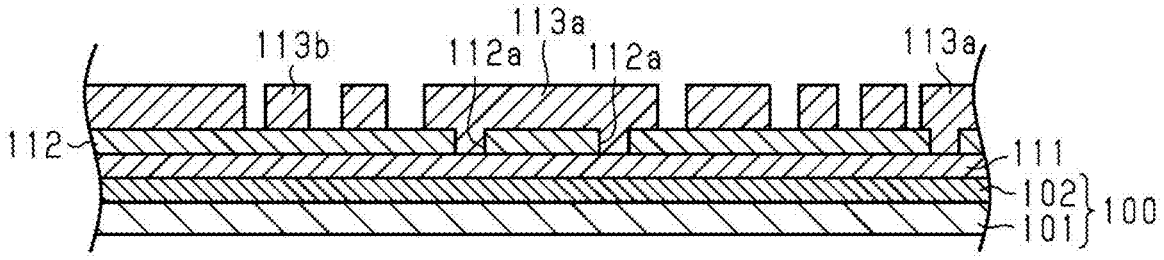
FIG. 12 is an explanatory diagram illustrating a production step of an inductor component according to an embodiment.

Thereafter, as illustrated in FIG. 12, dummy copper 113*a* and a spiral wiring line 113*b* are formed on the insulator 112. In particular, a power feed film (not shown in the drawing) for a SAP is formed on the insulator 112 by electroless plating, sputtering, evaporation, or the like. After the power feed film is formed, a photosensitive resist is formed on the power feed film by coating, bonding, or the like. In the photosensitive resist, cavities are formed at positions serving as a wiring line pattern by photolithography. Subsequently, metal wiring lines corresponding to the dummy copper 113*a* and the spiral wiring line 113*b* are formed in the cavities of the photosensitive resist layer. After the metal wiring lines are formed, the photosensitive resist is peeled by using a chemical agent and removed, and the power feed film is removed by etching. Thereafter, the metal wiring lines serve as a power feed portion, and the spiral wiring line 113*b* with a narrow space is obtained by performing additional electrolytic copper plating. The cavities 112*a* are filled with Cu by a SAP.

Figure 13:
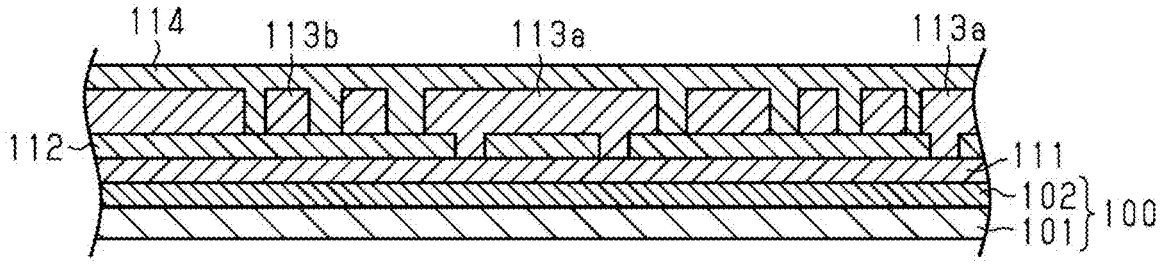
FIG. 13 is an explanatory diagram illustrating a production step of an inductor component according to an embodiment.

As illustrated in FIG. 13, the dummy copper 113*a* and the spiral wiring line 113*b* are covered with an insulator 114. The insulator 114 is heat-cured after being thermocompression-bonded by using a vacuum laminator, a pressing machine, or the like.

Figure 14:
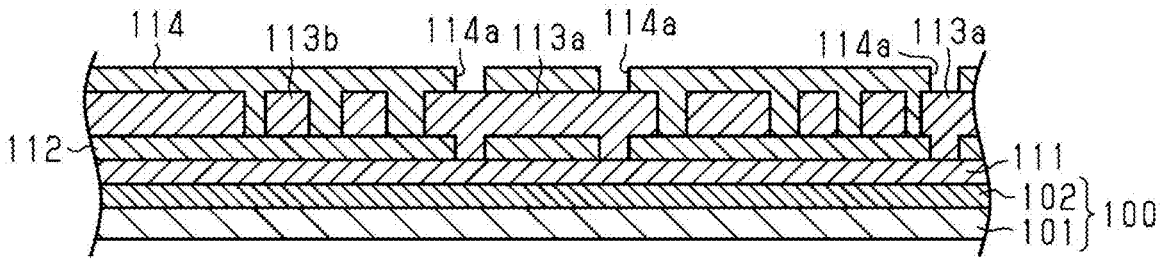
FIG. 14 is an explanatory diagram illustrating a production step of an inductor component according to an embodiment.

As illustrated in FIG. 14, cavities 114*a* are formed in the insulator 114 by laser beam machining or the like.

Figure 15:
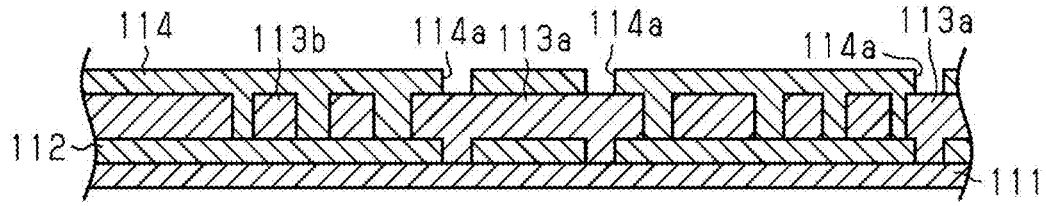
FIG. 15 is an explanatory diagram illustrating a production step of an inductor component according to an embodiment.

Thereafter, as illustrated in FIG. 15, the dummy core substrate 100 is peeled off the dummy metal layer 111.

Figure 16:
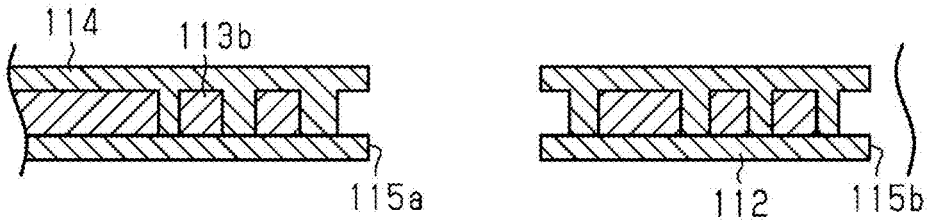
FIG. 16 is an explanatory diagram illustrating a production step of an inductor component according to an embodiment.

As illustrated in FIG. 16, the dummy metal layer 111 is removed by etching or the like. In addition, the dummy copper 113*a* is removed by etching or the like. Consequently, a hole portion 115*a* corresponding to the inner magnetic path portion 23 and a hole portion 115*b* corresponding to the outer magnetic path portion 24 are formed.

Figure 17:
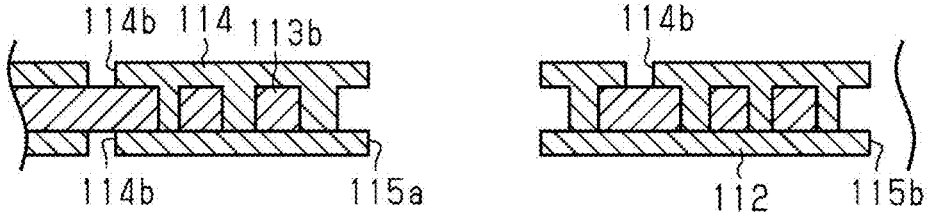
FIG. 17 is an explanatory diagram illustrating a production step of an inductor component according to an embodiment.

As illustrated in FIG. 17, cavities 114*b* are formed in the insulators 112 and 114 by laser beam machining or the like.

Figure 18:
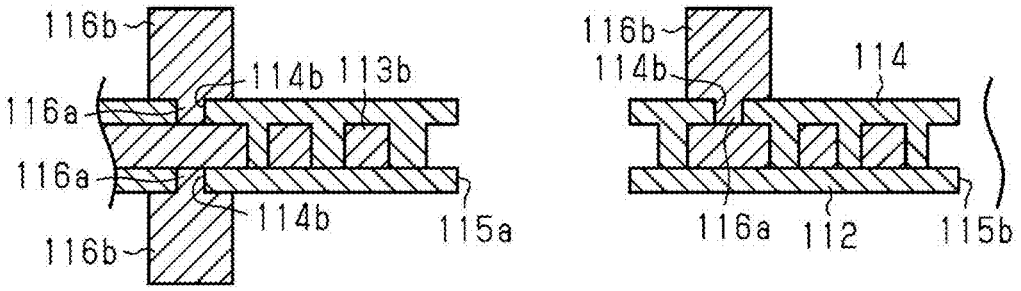
FIG. 18 is an explanatory diagram illustrating a production step of an inductor component according to an embodiment.

As illustrated in FIG. 18, the cavities 114*b* are filled with Cu by a SAP so as to form via conductors 116*a*, and, thereafter, columnar wiring lines 116*b* are formed on the insulators 112 and 114.

Figure 19:
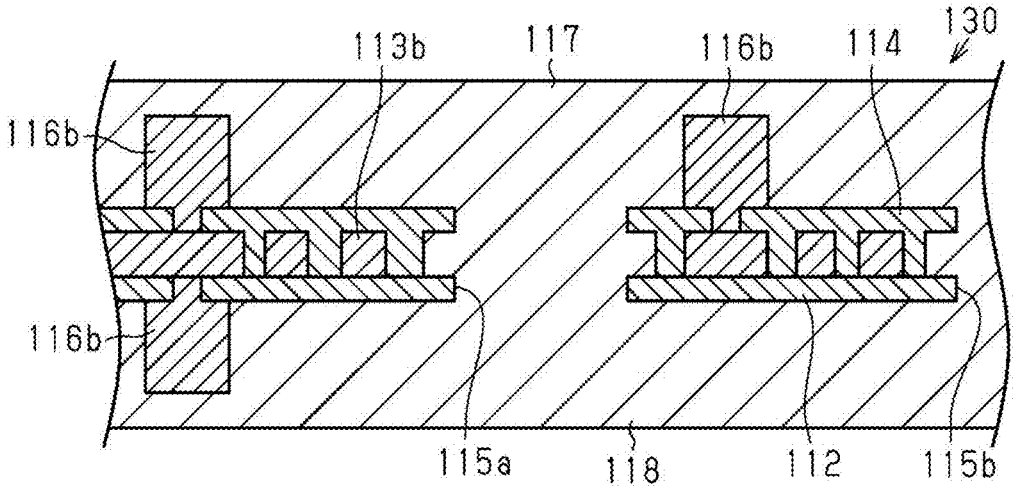
FIG. 19 is an explanatory diagram illustrating a production step of an inductor component according to an embodiment.

As illustrated in FIG. 19, an inductor substrate 130 is formed by covering the spiral wiring line 113*b*, the insulators 112 and 114, and the columnar wiring lines 116*b* with a magnetic body 117. The magnetic body 117 is formed of the organic resin 72 containing the magnetic powder 73 and the nonmagnetic powder 74, that is, a magnetic material 118 (refer to FIG. 3). The magnetic material 118 (magnetic body 117) is heat-cured after being thermocompression-bonded by using a vacuum laminator, a pressing machine, or the like. At this time, the hole portions 115*a* and 115*b* are also filled with the magnetic material 118.

Figure 20:
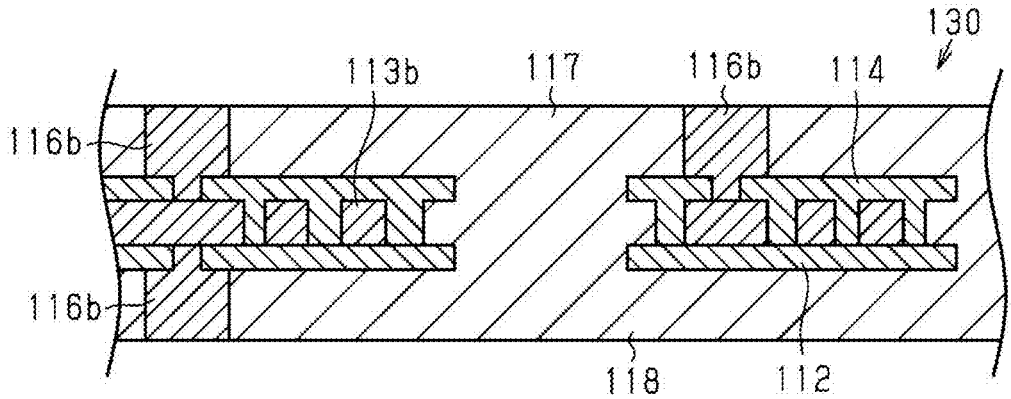
FIG. 20 is an explanatory diagram illustrating a production step of an inductor component according to an embodiment.

As illustrated in FIG. 20, the thickness of the magnetic material 118 in each of the upper portion and the lower portion of the inductor substrate 130 is reduced by using a grinding method. At this time, at least part of the columnar wiring line 116*b* is exposed by grinding the magnetic material 118, and, as a result, the exposed portion of the columnar wiring line 116*b* is formed so as to become flush with the magnetic material 118. In this regard, the thickness of the inductor component 1 can be reduced by grinding the magnetic material 118 until the thickness becomes sufficient for obtaining a predetermined inductance value.

Figure 21:
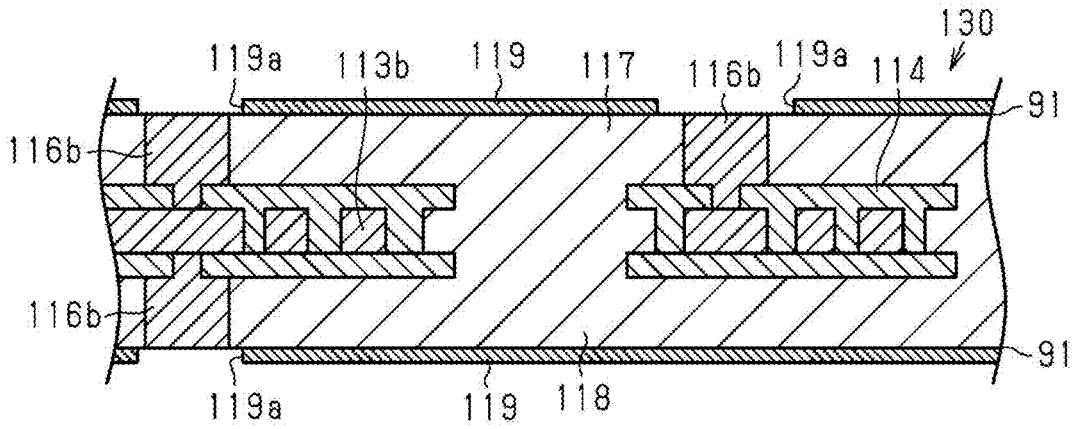
FIG. 21 is an explanatory diagram illustrating a production step of an inductor component according to an embodiment.

As illustrated in FIG. 21, insulating layers 119 are formed on the surfaces (upper surface and lower surface) of the magnetic body 117 by using a printing method. Each insulating layer 119 is formed of the organic resin 82 containing the insulating nonmagnetic powder 81, and the organic resin 82 does not contain a magnetic powder. Consequently, the nonmagnetic-body insulating layer 119 that does not contain a magnetic powder is formed on the surface of the magnetic body 117. When the insulating layer 119 is formed on the surface of the magnetic body 117, the close-contact layer 91 is simultaneously formed between the insulating layer 119 and the magnetic body 117. At this time, the magnetic powder 73 that extends over both the magnetic body 117 and the close-contact layer 91 is disposed in the boundary portion between the magnetic body 117 and the close-contact layer 91. Further, the nonmagnetic powder 81 that extends over both the insulating layer 119 and the close-contact layer 91 is disposed in the boundary portion between the insulating layer 119 and the close-contact layer 91. In this regard, the magnetic powder 73 and the nonmagnetic powder 81 are omitted from FIG. 21.

Regarding the specific method for forming the close-contact layer 91, for example, the surface of the magnetic body 117 is coated with an solvent, and, thereafter the insulating layer 119 is formed by coating, lamination, or the like. As a result, the solvent dissolves and mixes the magnetic body 117 and the insulating layer 119, and the close-contact layer 91 may be formed between the two. The method for forming the close-contact layer 91 is not limited to this method. The close-contact layer 91 may be formed by leading and fixing the magnetic powder 73 and the nonmagnetic powder 81 in the magnetic body 117 and the insulating layer 119 to between the magnetic body 117 and the insulating layer 119 by coating the surface of the magnetic body 117 with a surface modifier, for example, a silane coupling agent.

The insulating layer 119 formed on the magnetic body 117 has a cavity 119*a*. The cavity 119*a* is a portion to be provided with an external portion 121. In the present embodiment, the insulating layer 119 having the cavity 119*a* is formed by using the printing method. However, the cavity 119*a* may be formed by using a photolithography method.

Figure 22:
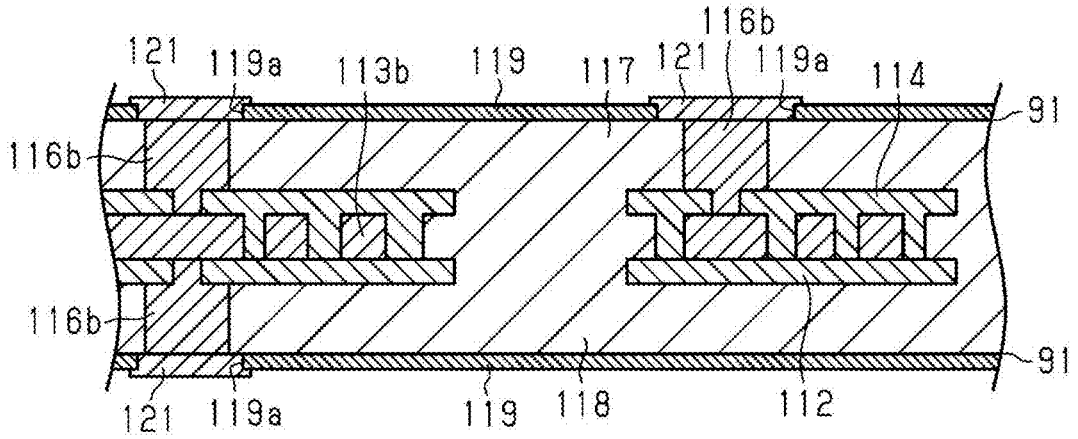
FIG. 22 is an explanatory diagram illustrating a production step of an inductor component according to an embodiment.

As illustrated in FIG. 22, the external terminals 121 are formed. The external terminals 121 are formed as a metal film of Cu, Ni, Au, Sn, or the like by electroless plating, electrolytic plating, or the like.

Figure 23:
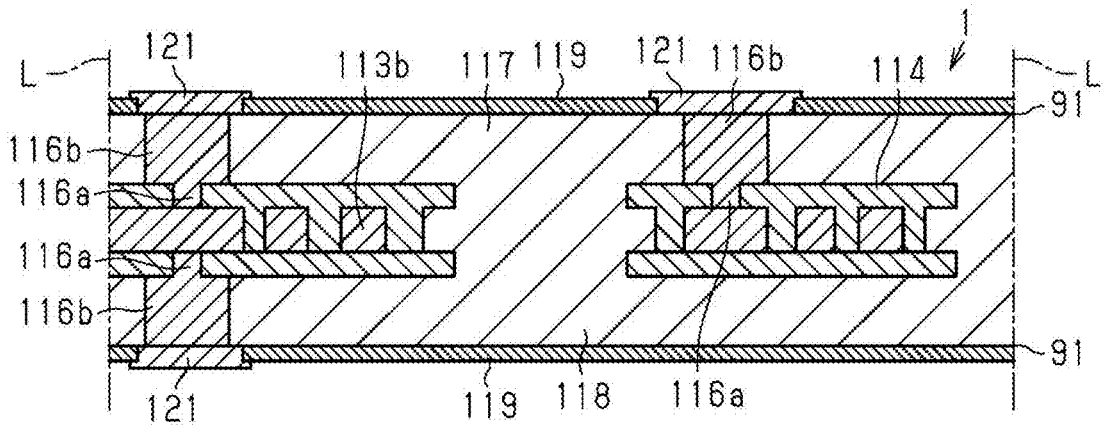
FIG. 23 is an explanatory diagram illustrating a production step of an inductor component according to an embodiment.

Thereafter, as illustrated in FIG. 23, an individual piece of the inductor component 1 illustrated in FIG. 2 is obtained by cutting with a dicing machine along the break lines L. In this regard, the spiral wiring line 113*b* illustrated in FIG. 23 corresponds to the spiral wiring line 11 illustrated in FIG. 2. The insulators 112 and 114 illustrated in FIG. 22 correspond to the insulator 31 illustrated in FIG. 2. The magnetic body 117 illustrated in FIG. 23 corresponds to the magnetic body 20, that is, the first magnetic layer 21, the second magnetic layer 22, the inner magnetic path portion 23, and the outer magnetic path portion 24 illustrated in FIG. 2. The three via conductors 116*a* illustrated in FIG. 23 correspond to via conductors 41*a* to 43*a* illustrated in FIG. 2. The three columnar wiring lines 116*b* illustrated in FIG. 23 correspond to the columnar wiring lines 41*b* to 43*b* illustrated in FIG. 2. The three external terminals 121 illustrated in FIG. 23 correspond to external terminals 51 to 53 illustrated in FIG. 2. Further, the two insulating layers 119 illustrated in FIG. 23 correspond to the insulating layers 61 and 62 illustrated in FIG. 2.

As described above, in the inductor component 1 according to the present embodiment, the spiral wiring line 11 is not formed on the printed circuit board in contrast to the related art. Therefore, there are advantages in thickness reduction of the inductor component 1 because the printed circuit board on which the spiral wiring line is formed is not provided. Regarding the configuration in which the spiral wiring line is formed on the printed circuit board in the related art, it is difficult to skip the substrate.

Although not illustrated in FIG. 12 or subsequent drawings, inductor substrates 130 may be formed on both surfaces of the dummy core substrate 100. This may enhance the productivity.

The operations and advantages of the present embodiment will be described.

(1) The inductor component 1 includes the spiral wiring line 11 that extends in a plane, the magnetic layers 21 and 22 that are formed of the organic resin 72 containing the magnetic powder 73 and that cover the spiral wiring line 11, and the nonmagnetic-body insulating layers 61 and 62 that are formed of the organic resin 82 containing the insulating nonmagnetic powder 81 and that cover the principal surfaces 21*a* and 22*a* of the magnetic layers 21 and 22, respectively. The inductor component 1 further includes the close-contact layers 91 that are located between the first magnetic layer 21 and the first insulating layer 61 and between the second magnetic layer 22 and the second insulating layer 62 and that contain the magnetic powder 73, the nonmagnetic powder 81, and the organic resin 92.

The close-contact layer 91 disposed between the first magnetic layer 21 and the first insulating layer 61 covering the principal surface 21*a* of the first magnetic layer 21 contains both the magnetic powder 73 included in the first magnetic layer 21 and the nonmagnetic powder 81 included in the first insulating layer 61. Therefore, the close-contact layer 91 readily comes into close contact with the first magnetic layer 21 and readily comes into close contact with the first insulating layer 61. Consequently, the close-contact layer 91 in close contact with the first magnetic layer 21 and the first insulating layer 61 interposing between the first magnetic layer 21 and the first insulating layer 61 covering the principal surface 21*a* of the first magnetic layer 21 enables the adhesiveness between the first insulating layer 61 and the principal surface 21*a* of the first magnetic layer 21 to be suppressed from deteriorating. Likewise, the close-contact layer 91 disposed between the second magnetic layer 22 and the second insulating layer 62 covering the principal surface 22*a* of the second magnetic layer 22 contains both the magnetic powder 73 included in the second magnetic layer 22 and the nonmagnetic powder 81 included in the second insulating layer 62. Therefore, the close-contact layer 91 readily comes into close contact with the second magnetic layer 22 and readily comes into close contact with the second insulating layer 62. Consequently, the close-contact layer 91 in close contact with the second magnetic layer 22 and the second insulating layer 62 interposing between the second magnetic layer 22 and the second insulating layer 62 that covers the principal surface 22*a* of the second magnetic layer 22 enables the adhesiveness between the second insulating layer 62 and the principal surface 22*a* of the second magnetic layer 22 to be suppressed from deteriorating.

(2) The filling ratio of the magnetic powder 73 in each of the first magnetic layer 21 and the second magnetic layer 22 is about 50% by volume or more and 90% by volume or less (i.e., from about 50% by volume to 90% by volume). Therefore, in the inductor component 1 in which the filling ratio of the magnetic powder 73 in each of the first magnetic layer 21 and the second magnetic layer 22 is about 50% by volume or more and 90% by volume or less (i.e., from about 50% by volume to 90% by volume), the adhesiveness between the first insulating layer 61 and the principal surface 21*a* of the first magnetic layer 21 and the adhesiveness between the second insulating layer 62 and the principal surface 22*a* of the second magnetic layer 22 can be suppressed from deteriorating.

(3) The filling ratio of the magnetic powder 73 in the close-contact layer 91 decreases with increasing proximity to the first insulating layer 61 from the first magnetic layer 21. Therefore, in the close-contact layer 91 located between the first magnetic layer 21 and the first insulating layer 61, the portion near the first magnetic layer 21 has a composition close to the composition of the first magnetic layer 21 and the portion near the first insulating layer 61 has a composition close to the composition of the first insulating layer 61. Consequently, the close-contact layer 91 comes into closer contact with each of the first magnetic layer 21 and the first insulating layer 61. Meanwhile, since the magnetic powder ratio in the close-contact layer 91 gradually changes with increasing proximity to the first insulating layer 61 from the first magnetic layer 21, the stress generated between the principal surface 21*a* of the first magnetic layer 21 and the first insulating layer 61 that covers the principal surface 21*a* can be relaxed. As a result, the adhesiveness between the first insulating layer 61 and the principal surface 21*a* of the first magnetic layer 21 can be suppressed from deteriorating.

Likewise, the filling ratio of the magnetic powder 73 in the close-contact layer 91 decreases with increasing proximity to the second insulating layer 62 from the second magnetic layer 22. Therefore, in the close-contact layer 91 located between the second magnetic layer 22 and the second insulating layer 62, the portion near the second magnetic layer 22 has a composition close to the composition of the second magnetic layer 22 and the portion near the second insulating layer 62 has a composition close to the composition of the second insulating layer 62. Consequently, the close-contact layer 91 comes into closer contact with each of the second magnetic layer 22 and the second insulating layer 62. Meanwhile, since the magnetic powder ratio in the close-contact layer 91 gradually changes with increasing proximity to the second insulating layer 62 from the second magnetic layer 22, the stress generated between the principal surface 22*a* of the second magnetic layer 22 and the second insulating layer 62 that covers the principal surface 22*a* can be relaxed. As a result, the adhesiveness between the second insulating layer 62 and the principal surface 22*a* of the second magnetic layer 22 can be suppressed from deteriorating.

(4) The thickness T1 of the close-contact layer 91 is about 1/10 times or more and 1/3 times or less (i.e., from about 1/10 times to 1/3 times) the thickness B of each of the insulating layers 61 and 62. Therefore, since the close-contact layer 91 is thinner than each of the insulating layers 61 and 62, the thickness of the inductor component 1 is suppressed from increasing due to the close-contact layer 91, and the adhesiveness between the first insulating layer 61 and the principal surface 21*a* of the first magnetic layer 21 and the adhesiveness between the second insulating layer 62 and the principal surface 22*a* of the second magnetic layer 22 can be suppressed from deteriorating.

(5) The magnetic powder 73 in the close-contact layer 91 contains a type of particles having a nonspherical shape. Consequently, the anchor effect due to the magnetic powder 73 having particles with a nonspherical shape is readily obtained. Therefore, the adhesiveness between the first insulating layer 61 and the principal surface 21*a* of the first magnetic layer 21 and the adhesiveness between the second insulating layer 62 and the principal surface 22*a* of the second magnetic layer 22 can be further suppressed from deteriorating.

(6) The nonmagnetic powder 81 in the close-contact layer 91 contains different types of particles in terms of material. Different nonmagnetic powders (in the present embodiment, two nonmagnetic powders, the nonmagnetic powder 81*a* and the nonmagnetic powder 81*b*) being included enables the close-contact layer 91 to endure different types of stress. Therefore, the adhesiveness between the first insulating layer 61 and the principal surface 21*a* of the first magnetic layer 21 and the adhesiveness between the second insulating layer 62 and the principal surface 22*a* of the second magnetic layer 22 can be further suppressed from deteriorating.

(7) The nonmagnetic powder 81 in the close-contact layer 91 contains two types of particles, the nonmagnetic powders 81*a* and 81*b*, different from each other in particle dimension by a factor of about 1.5 or more. The nonmagnetic powder 81*a* and the nonmagnetic powder 81*b* that differ from each other in particle dimension by a factor of about 1.5 or more being mixed and contained in the close-contact layer 91 enhances the strength of the close-contact layer 91. Therefore, the adhesiveness between the first insulating layer 61 and the principal surface 21*a* of the first magnetic layer 21 and the adhesiveness between the second insulating layer 62 and the principal surface 22*a* of the second magnetic layer 22 can be further suppressed from deteriorating by the close-contact layer 91.

(8) The nonmagnetic powder 81 in the close-contact layer 91 contains a type of particles containing Si and O. In the present embodiment, one type, the nonmagnetic powder 81*a*, of the two types in the nonmagnetic powder 81 is $SiO_2$ containing Si and O. Since the nonmagnetic powder 81*a* containing Si and O is readily and inexpensively available, the production cost of the inductor component 1 can be reduced, and the inductor component 1 having excellent mass productivity can be obtained.

(9) The nonmagnetic powder 81 in the close-contact layer 91 contains a type of particles containing Ba and S. In the present embodiment, one type, the nonmagnetic powder 81*b*, of the two types in the nonmagnetic powder 81 is $BaSO_4$ containing Ba and S. Since the nonmagnetic powder 81*b* containing Ba and S is readily and inexpensively available, the production cost of the inductor component 1 can be reduced, and the inductor component 1 having excellent mass productivity can be obtained.

(10) The nonmagnetic powder 81 in the close-contact layer 91 contains a type of particles having a nonspherical shape. In the present embodiment, particles of one type, the nonmagnetic powder 81*b*, of two types in the nonmagnetic powder 81 have nonspherical shapes. Particles of the nonspherical nonmagnetic powder 81*b* (for example, a pulverized filler) readily stick into the organic resin 92 (that is, not readily come out). Consequently, when stress is generated in the direction of the first insulating layer 61 peeling off, the first insulating layer 61 is suppressed from peeling off the first magnetic layer 21 by the nonspherical nonmagnetic powder 81*b* contained in the close-contact layer 91 located between the first magnetic layer 21 and the first insulating layer 61. Likewise, when stress is generated in the direction of the second insulating layer 62 peeling off, the second insulating layer 62 is suppressed from peeling off the second magnetic layer 22 by the nonspherical nonmagnetic powder 81*b* contained in the close-contact layer 91 located between the second magnetic layer 22 and the second insulating layer 62. Therefore, the adhesiveness between the first insulating layer 61 and the principal surface 21*a* of the first magnetic layer 21 and the adhesiveness between the second insulating layer 62 and the principal surface 22*a* of the second magnetic layer 22 can be further suppressed from deteriorating.

(11) The inductor component 1 includes the external terminals 51 to 53 disposed on the principal surface 21*a* or the principal surface 22*a* of the magnetic layers 21 and 22. The external terminals 51 to 53 cover a part of the principal surface 61*d* or the principal surface 62*d* of the insulating layers 61 and 62. Consequently, the second insulating layer 62 covering the principal surface 22*a* of the second magnetic layer 22 is pressed against the second magnetic layer 22 by the external terminals 51 and 52. Therefore, regarding the second insulating layer 62, in the portions in which the principal surface 62*d* is covered with the external terminals 51 and 52, movement in the direction away from the principal surface 22*a* is hindered by the external terminals 51 and 52. Likewise, the first insulating layer 61 covering the principal surface 21*a* of the first magnetic layer 21 is pressed against the first magnetic layer 21 by the external terminal 53. Therefore, regarding the first insulating layer 61, in the portions in which the principal surface 61*d* is covered with the external terminal 53, movement in the direction away from the principal surface 21*a* is hindered by the external terminal 53. As a result, the adhesiveness between the first insulating layer 61 and the principal surface 21*a* of the first magnetic layer 21 and the adhesiveness between the second insulating layer 62 and the principal surface 22*a* of the second magnetic layer 22 can be further suppressed from deteriorating.

(12) When T represents the thickness of the inductor component 1, the thickness B of each of the insulating layers 61 and 62 is T/100 or more and T/20 or less (i.e., from T/100 to T/20). The thickness B of each of the insulating layers 61 and 62 being T/100 or more enables the strength of the inductor component 1 to be enhanced. Meanwhile, if the thickness B of each of the insulating layers 61 and 62 is more than T/20, the volume (proportion) of the nonmagnetic-body insulating layer 61 in the inductor component 1 increases and, thereby, the inductance is reduced. Therefore, setting the thickness of each of the insulating layers 61 and 62 to be T/20 or less enables the inductance to be suppressed from reducing. As a result, the inductor component 1 can be provided, wherein the strength is enhanced, the inductance is suppressed from reducing, and the adhesiveness between the first insulating layer 61 and the principal surface 21*a* of the first magnetic layer 21 and the adhesiveness between the second insulating layer 62 and the principal surface 22*a* of the second magnetic layer 22 are further suppressed from deteriorating.

(13) The filling ratio of the magnetic powder 73 in the overall close-contact layer 91 is preferably about 1% by volume or more and 60% by volume or less (i.e., from about 1% by volume to 60% by volume). If the amount of the magnetic powder 73 included in the close-contact layer 91 is excessively increased, a space for including the nonmagnetic powder 81 is reduced. That is, in the close-contact layer 91 located between the first magnetic layer 21 and the first insulating layer 61, the space for including the nonmagnetic powder 81 that contributes to improvement of the adhesiveness between the first insulating layer 61 and the principal surface 21*a* of the first magnetic layer 21 is reduced. Likewise, in the close-contact layer 91 located between the second magnetic layer 22 and the second insulating layer 62, the space for including the nonmagnetic powder 81 that contributes to improvement of the adhesiveness between the second insulating layer 62 and the principal surface 22*a* of the second magnetic layer 22 is reduced. As a result, there is a possibility of ensuring the adhesiveness between the first insulating layer 61 and the principal surface 21*a* of the first magnetic layer 21 and the adhesiveness between the second insulating layer 62 and the principal surface 22*a* of the second magnetic layer 22 becoming difficult. On the other hand, if the amount of the magnetic powder 73 included in the close-contact layer 91 is excessively decreased, the ratio of the organic resin 92 increases, and, as a result, there is a possibility of ensuring the adhesiveness between the first insulating layer 61 and the principal surface 21*a* of the first magnetic layer 21 and the adhesiveness between the second insulating layer 62 and the principal surface 22*a* of the second magnetic layer 22 becoming difficult. Therefore, setting the filling ratio of the magnetic powder 73 in the overall close-contact layer 91 to be about 1% by volume or more and 60% by volume or less (i.e., from about 1% by volume to 60% by volume) facilitates ensuring the adhesiveness between the first insulating layer 61 and the principal surface 21*a* of the first magnetic layer 21 and the adhesiveness between the second insulating layer 62 and the principal surface 22*a* of the second magnetic layer 22.

Modified Examples

The present embodiment may be modified as described below and realized. The present embodiment and the modified examples below may be combined with each other and realized within the bounds of not causing a technical contradiction.

In the above-described embodiment, the inductor component 1 has a configuration in which only one spiral wiring line 11 is included. However, the inductor component 1 may include a plurality of spiral wiring lines 11. Specifically, the inductor component may include a plurality of spiral wiring lines in the same plane. For example, in the inductor component 1 of the above-described embodiment, a plurality of spiral wiring lines 11 may be disposed in the same plane. Alternatively, the inductor component may include a plurality of spiral wiring lines stacked between a pair of magnetic layers. For example, the inductor component 1 of the above-described embodiment may have a configuration in which a plurality of spiral wiring lines 11 are stacked and interposed between the first magnetic layer 21 and the second magnetic layer 22. The inductor component including a plurality of spiral wiring lines stacked between a pair of magnetic layers may be configured to include a plurality of spiral wiring lines in the same plane.

In the above-described embodiment, the magnetic body 20 includes two magnetic layers, the first magnetic layer 21 and the second magnetic layer 22. However, the magnetic body 20 may be configured to include at least three magnetic layers that are formed of an organic resin containing a magnetic powder and that cover the spiral wiring line 11.

In the above-described embodiment, the organic resin 72 constituting the first magnetic layer 21 and the second magnetic layer 22 may further contain a ferrite powder. The organic resin 72 constituting the inner magnetic path portion 23 and the outer magnetic path portion 24 may also further contain a ferrite powder. Consequently, the first magnetic layer 21 and the second magnetic layer 22 further containing the ferrite powder enables the inductance to be increased.

The shape of the insulator 31, the shapes of the vertical wiring lines 41 to 43, and the shapes of the external terminals 51 to 53 are not limited to the shapes in the above-described embodiment and may be appropriately changed. For example, the insulator 31 may have a shape that partly covers the surface of the spiral wiring line 11. Meanwhile, the number of the vertical wiring lines and the number of the external terminals are not limited to the numbers in the above-described embodiment and may be appropriately changed.

In the inductor component 1 of the above-described embodiment, the volume resistivity of each of the magnetic layers 21 and 22, the insulator 31, and the insulating layers 61 and 62 is preferably about 1 MΩ·cm or more. Consequently, current leakage of the inductor component 1 may be reduced. In particular, the volume resistivity of each of the insulator 31 and the insulating layers 61 and 62 is preferably about 1 TΩ·cm or more. In this case, each of the insulator 31 and the insulating layers 61 and 62 is composed of, for example, a solder resist or a polyimide.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

an inductor wiring line that extends in a plane;

a magnetic layer that is configured of an organic resin containing a magnetic powder and that covers the inductor wiring line;

a nonmagnetic-body insulating layer that is configured of an organic resin containing an insulating nonmagnetic powder and that covers a principal surface of the magnetic layer;

a close-contact layer that is located between the magnetic layer and the insulating layer and that contains the magnetic powder, the nonmagnetic powder, and an organic resin; and an external terminal disposed on the principal surface of the magnetic layer, wherein the external terminal covers a part of a principal surface of the insulating layer.

2. The inductor component according to claim 1, wherein a filling ratio of the magnetic powder in the magnetic layer is from 50% by volume to 90% by volume.

3. The inductor component according to claim 1, wherein a filling ratio of the magnetic powder in the close-contact layer decreases with increasing proximity from the magnetic layer to the insulating layer.

4. The inductor component according to claim 1, wherein a thickness of the close-contact layer is from 1/10 times to 1/3 times a thickness of the insulating layer.

5. The inductor component according to claim 1, wherein the magnetic powder in the close-contact layer contains a type of particles having a nonspherical shape.

6. The inductor component according to claim 1, wherein the nonmagnetic powder in the close-contact layer contains different types of particles in terms of material.

7. The inductor component according to claim 1, wherein the nonmagnetic powder in the close-contact layer contains two types of particles different from each other in particle dimension by a factor of 1.5 or more.

8. The inductor component according to claim 1, wherein the nonmagnetic powder in the close-contact layer contains a type of particles containing Si and O and another type of particles containing Ba and S.

9. The inductor component according to claim 6, wherein the nonmagnetic powder in the close-contact layer contains a type of particles containing Ba and S.

10. The inductor component according to claim 1, wherein the nonmagnetic powder in the close-contact layer contains a type of particles having a nonspherical shape.

11. The inductor component according to claim 1, wherein a thickness of the insulating layer is from T/100 to T/20, where T represents a thickness of the inductor component.

12. The inductor component according to claim 1, wherein the magnetic powder contains particles, and some of the particles have a portion in the magnetic layer and another portion in the close-contact layer.

13. The inductor component according to claim 12, wherein other of the particles are entirely within the close-contact layer.

14. The inductor component according to claim 12, wherein the some of the particles have a nonspherical shape.

15. The inductor component according to claim 1, wherein the nonmagnetic powder in the close-contact layer contains a type of particles having a substantially spherical shape.

16. The inductor component according to claim 15, wherein the nonmagnetic powder in the close-contact layer contains another type of particles having a nonspherical shape.

17. The inductor component according to claim 1, wherein the nonmagnetic powder contains particles, and some of the particles have a portion in the nonmagnetic-body insulating layer and another portion in the close-contact layer.

18. The inductor component according to claim 17, wherein other of the particles are entirely within the close-contact layer.

19. The inductor component according to claim 18, wherein the some of the particles have a substantially spherical shape or a nonspherical shape; and the other of the particles have a substantially spherical shape or a nonspherical shape.

* * * * *